US006563260B1

(12) United States Patent
Yamamoto et al.

(10) Patent No.: US 6,563,260 B1
(45) Date of Patent: May 13, 2003

(54) ELECTRON EMISSION ELEMENT HAVING RESISTANCE LAYER OF PARTICULAR PARTICLES

(75) Inventors: Masahiko Yamamoto, Kanagawa-ken (JP); Miki Mori, Kanagawa-ken (JP); Yumi Fukuda, Kanagawa-ken (JP); Hitoshi Kobayashi, Kanagawa-ken (JP); Yujiro Hara, Kanagawa-ken (JP); Goh Itoh, Kanagawa-ken (JP); Masayuki Saito, Kanagawa-ken (JP); Toshiro Hiraoka, Kanagawa-ken (JP); Koji Asakawa, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/525,531

(22) Filed: Mar. 15, 2000

(30) Foreign Application Priority Data

Mar. 15, 1999 (JP) ..... 11-069285

(51) Int. Cl.[7] ..... H01J 1/62; H01J 63/04
(52) U.S. Cl. ..... 313/495; 313/496; 313/509
(58) Field of Search ..... 313/495, 496, 313/498, 506, 509

(56) References Cited

U.S. PATENT DOCUMENTS 4,845,533 A * 7/1989 Pryor et al. ..... 257/4
4,940,916 A * 7/1990 Borel et al. ..... 313/306
5,019,003 A 5/1991 Chason et al. ..... 445/24
5,451,830 A * 9/1995 Huang ..... 313/309

(List continued on next page.)

FOREIGN PATENT DOCUMENTS

JP 7-201275 8/1995
JP 08-77916 3/1996
JP 8-96703 4/1996

(List continued on next page.)

OTHER PUBLICATIONS

Shoulders et al., "Advance in Computers", Academic Press, New York, London, 1961, vol. 2, pp. 135–137, 160–163.

(List continued on next page.)

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

A display device has an array formed on a substrate including a cathode wiring line layer, a gate wiring line layer and an insulating layer for electrically insulating the cathode wiring line layer and the gate wiring line layer from each other. Holes are formed at the crossing portion between the cathode wiring line layer and the gate wiring line layer so as to penetrate through the insulating layer, and resistive layer and an emitter layer are provided in the holes. The resistive layer has such a structure that conductive fine particles are dispersed in a base material of insulating fine particles, and the emitter layer is formed of a fine particle material. The insulating layer between the cathode electrode lines and the gate electrodes is formed of a silicon oxide film containing fluorine. When a large number of elements are formed over a large area in an electron emission device using fine particle emitters, there can be provided electron emission elements which can suppress the unevenness of the electron emission amount. According to the present invention, there can be provided a large-area and uniform display device which can be operated with a low driving voltage, and have a long lifetime.

24 Claims, 15 Drawing Sheets

U.S. PATENT DOCUMENTS

| | | | | | |
|---|---|---|---|---|---|
| 5,557,160 | A | * | 9/1996 | Makishima et al. | 313/336 |
| 5,760,536 | A | * | 6/1998 | Susukida et al. | 313/311 |
| 5,770,919 | A | * | 6/1998 | Tjaden et al. | 313/495 |
| 5,804,910 | A | * | 9/1998 | Tjaden et al. | 313/310 |
| 5,808,403 | A | * | 9/1998 | Clerc | 313/336 |
| 5,821,679 | A | * | 10/1998 | Makishima | 313/310 |
| 5,847,496 | A | * | 12/1998 | Nakamoto et al. | 313/336 |
| 5,872,422 | A | * | 2/1999 | Xu et al. | 313/311 |
| 5,920,296 | A | * | 7/1999 | Garcia | 345/74 |
| 6,013,986 | A | * | 1/2000 | Knall et al. | 315/169.3 |
| 6,031,322 | A | * | 2/2000 | Takemura et al. | 313/309 |
| 6,034,468 | A | * | 3/2000 | Wilshaw | 313/309 |
| 6,133,678 | A | * | 10/2000 | Kishino et al. | 313/309 |
| 6,163,107 | A | * | 12/2000 | Itoh et al. | 313/495 |
| 6,255,771 | B1 | * | 7/2001 | Jones et al. | 313/495 |

FOREIGN PATENT DOCUMENTS

| | | | | |
|---|---|---|---|---|
| JP | 08148083 | A | * | 6/1996 |
| JP | 8-227655 | | | 9/1996 |
| JP | 8-234682 | | | 9/1996 |
| JP | 08-241665 | | | 9/1996 |
| JP | 08321253 | A | * | 12/1996 |
| JP | 08-329823 | | | 12/1996 |
| JP | 09161665 | A | * | 6/1997 |
| JP | 09219141 | A | * | 8/1997 |
| JP | 10-31954 | | | 2/1998 |
| JP | 10031956 | A | * | 2/1998 |
| JP | 10-92294 | | | 4/1998 |
| JP | 10-92298 | | | 4/1998 |
| JP | 10092295 | A | * | 4/1998 |

OTHER PUBLICATIONS

Spindt, "A Thin–Film Field–Emission Cathode", Journal of Applied Physics 39, 1968, pp. 3504–3505.

Itoh et al., "Experimental study of field emission properties of the Spindt–type field emitter", Journal of Vacuum Science and Technology B 13 (2), Mar./Apr. 1995, pp. 487–490.

Zhirnov et al., "Wide band gap materials for field emission devices", Journal of Vacuum Science and Technology A, 15(3), 1997, pp. 1733–1738.

Zhu et al., "Low–Field Electron Emission from Updoped Nanostructured Diamond", Science, vol. 282, Nov. 20, 1998, pp. 1471–1472.

Busta et al., "Performance of laser ablated, laser annealed BN emitters deposited on polycrystalline diamond", Journal of Vacuum Science and Technology B, vol. 16, May/Jun. 1998, pp. 1207–1210.

Geis et al., "Diamond emitters fabrication and theory" Journal of Vacuum Science and Technologies B, vol. 14, May/Jun. 1996, pp. 2060–2067.

* cited by examiner

ELECTRON EMISSION ELEMENT HAVING RESISTANCE LAYER OF PARTICULAR PARTICLES

BACKGROUND OF THE INVENTION

1. Field of the Invention

The present invention relates to an electron emission element and a method of manufacturing the electron emission element, and also to a display device using the electron emission element and a method of manufacturing the display device. The present invention is applicable to an image display device, an electron beam exposing device, etc.

2. Description of the Related Art

Application of high electric field of about $10^7$ (V/cm) level to the surface of metal or semiconductor induces such a phenomenon that electrons are emitted from the surface of metal or semiconductor into vacuum, and this phenomenon is called as "field emission". The field emission is caused by tunneling of electrons in the vicinity of the Fermi energy level in metal or electrons excited up to the conduction electron band into the vacuum level. However, in the case of the semiconductor, electrons located in the valence band or various levels existing between the bands, such as the impurity levels, the surface levels, etc. may be emitted.

A field emission type cold cathode has such a merit that the electron emission current density can be set to a larger value as compared with that of a thermionic cathode. In the case of thermionic cathodes, the field emission density is limited to about several tens of amperes per one square centimeter at maximum. On the other hand, with cold cathodes, the electron emission current density of about $10^7$ to $10^9$ amperes per one square centimeter can be achieved. Therefore, use of the field emission type cold cathode is particularly effective to design micron-sized miniature vacuum electron devices.

An actual example of a vacuum micro-electric device using the cold cathode, was first reported by Shoulders in 1961(Adv.Comput.2(1961)135), and he reported a method of manufacturing a 0.1-micron size device and a minute field emission type diode by using the above device. Further, Spindt, et al. reported fabrication of an array structure in which a number of micron-size cold cathodes (triodes) having gates formed on a single substrate by a thin film technique (J. Appl. Phys. 39 (1968) 3504). Following this year, various reports have been submitted.

Various types of structures have been proposed for the vacuum micro-electronic device. According to the report of Spindt, et al., there is proposed a structure having a micron-size minute conical emitter having a sharp tip and a electron extracting electrode (gate) having an open portion located just above the emitter. An anode is provided above the emitter.

With such a structure, the electric field is concentrated on the tip portion of the emitter, and the current of electrons emitted from the emitter to the anode can be controlled by the voltage applied across the gate and the emitter.

As other examples of devices having the same structure, there have been reported various reports for manufacturing the devices having the same structure by using a method using anisotropic etching of Si (Grey's method), a mold method using a mold or the like. The common features of the conventional electron emission elements having the above structure resides in that each of these structures has an extremely sharp emitter tip portion, the radius of curvature of which is equal to about several nanometers, and that the electric field applied at the tip by the difference between the gate voltage and the emitter voltage is increased 100 times to about 1000 times as compared to the voltage difference divided by the gate-emitter distance, resulting from the effect of the concentration of the electric field at the sharply pointed tip of the emitter.

The diameter of the opening portion of the gate ranges from the micron order to the sub-micron order. An actual manufacturing process of these elements need to position the gate and the conical emitter inside the minute opening portion. It is technically and economically difficult to perform such a precise positioning work by using lithography. This difficulty can be avoided by using self-alignment techniques. However, use of such techniques rather causes lots of restrictions.

For example, a manufacturing process based on Spindt's method will be described.

First, after a gate opening is provided, a peeling layer is formed on the top surface of the gate while the film thereof is prevented from being deposited inside the gate. Subsequently, an emitter material is vapor-deposited from the vertical direction. At this time, the opening diameter of the gate becomes gradually smaller due to the increase of the emitter material adhering to the edge of the opening portion of the gate, so that a conical emitter is formed inside the gate opening. Thereafter, the emitter material adhering to the opening portion of the gate is removed by removing the peeling layer.

As reported in J. Vac. Sci. Technol. B13(1995) 487, a conical shape having an ideal ratio (diameter of bottom surface: height) (aspect ratio) can be formed when Mo is used; however, it cannot be formed when Ti or Zr is used. That is, the material usable for the emitter is limited to special materials not only in consideration of the physical properties which directly affect the field emission characteristics, but also in terms of the shaping of the elements. Accordingly, the emitter material is substantially limited to Mo due to a requirement for forming a conical body having an excellent shape in the vapor-deposition process.

Likewise, the emitter material is limited to Si in the gray method because the tip of the Si conical body is sharpened by thermal oxidation in the Gray's method.

These methods are too low in flexibility to reduce the cost by reconsidering the process and the material.

In order to widen the range of the materials usable for the emitter, it is required to loosen the restriction caused by the manufacturing process, and the following method is known to satisfy this requirement.

This method directs to such an approach that an emitter having a single emission point is not necessarily located at the center portion of the gate, and but a plurality of emission points are provided in the opening portion of the gate, thereby omitting the positioning work between the gate and emitter. Even when this approach is used, the electron emission amount is actually prevented from being remarkably lowered although the loss of the effective current due to withdrawal of electrons emitted from the emitter by the gate is increased.

In general, there are two factors influencing the intensity of electric field at the tip of the emitter. The one is the sharpness of the tip of the emitter and the other is the distance between the gate and the tip of the emitter. Since the electric-field intensity is more greatly dependent on the sharpness of the tip of the emitter, the above approach can be effectively used. Accordingly, this approach makes it easier technically and economically to form a large-area array of electron emission elements. Such an approach is classified into two types.

One type of approach relates to a method of providing an electric-field concentration structure. For example, Japanese Laid-open Patent Application No. Hei-8-329823 discloses such a structure that an infinite number of columnar crystals of beta type tungsten are grown in the opening portion of the gate and electrons are emitted from the pointed portions of the respective crystals.

The other type of approach uses materials having small work function or small electron affinity. This method enables electron emission from a film having no discrete pointed portions. In general, as the work function or the electron affinity is reduced, the field emission is more likely to occur. Semiconductor materials having a broad band gap of about 5 electron volts or more can be used as materials having especially excellent characteristics for such a film. For example, as these materials are known diamond, boron nitride of cubic or hexagonal system, lithium fluoride, calcium fluoride or the like which have extremely low electron affinities.

For these materials, it has been confirmed or suggested that generally, the lowest energy levels of the conduction bands of these materials are lower than the vacuum level compared to the energy state of electrons under vacuum; however, they are nearly equal to the vacuum level within the range from 0.1 to 0.5 eV, or even higher than the vacuum level in some crystal face directions. These materials are called as "negative electron affinity (NEA) materials" or "quasi negative electron affinity materials" (for example, J. Vac. Sci. Technol. B13(1997)1733).

Each of these materials has such a property that electrons are emitted to the vacuum without strong electric field at the interface between the material and the vacuum because of its negative electron affinity (NEA) property. This effect is realized by forming a conduction passage based on doping, defect/hydrogen termination or the like on the surface of the material or in the bulk thereof and then injecting electrons into the conduction band.

There has been also reported an experimental result suggesting that electric-field electron emission occurs from a conductive microstructure formed in the bulk or on the surface (for example, Science 282(1998)1471). However, in this case, the electron emission does not necessarily occur from the conduction band unlike the electron emission based on NEA. But the electron emission occurs from local levels due to defects or the like existing between the bands or from the valence band. Therefore, the electron emission are not necessarily induced by a mechanism which positively utilizes small electron affinity.

However, most of these materials have excellent characteristics in surface chemical stability and thermal conductivity, and thus the field emission characteristic thereof is less sensitive to the variation of the surface state and thus more stable as compared with the field emission from the metal surface of Mo or the like.

An electron emission element using a projecting structure of metal material does not stably operate under a normal condition unless it is kept under an atmosphere of $10^{-7}$ torr or less because its characteristic is very sensitive to the surface state. On the other hand, it has been suggested that an electron emission element using diamond or boron nitride can stably operate even under a low vacuum condition of about $10^{-5}$ torr (J. Vac. Sci. Technol. B16(1998)1207).

Two methods, a film formation method using vacuum deposition and a method using fine particles of NEA material are known for manufacturing an electron emission element using the above NEA material/quasi NEA material (hereinafter collectively referred to as "NEA material").

Various methods such as a plasma CVD method, a hot filament CVD method, a filtered cathode arc method (FCVAD), a laser application method, etc. have been reported as the vacuum deposition method for diamond, boron nitride of cubic system which are representative NEA materials. The films produced by these methods exhibit polycrystalline structure but, however, are relatively excellent in local uniformity in crystal grain.

Conversely, when the electron emission element is applied to an electron source used for a large-size electron exciting type flat panel display (FED), a large-size film forming apparatus, typically a vacuum chamber, is needed and this causes increase of the cost. This is because the size of the film which can be formed is limited by the size of the film forming apparatus.

Further, the vapor-deposited film of diamond or the like has a large in-film stress and thus it is liable to be peeled off after the film forming process, which induces a practical problem.

These problems can be avoided by using minute crystal grains of sub micron size in place of the vapor deposition film. For example, the sub micron size minute crystals of boron nitride of cubic system are industrially produced for an application to polishing particles for polishing, and they are moderate in cost, so that this method is practical for forming a large-area electron emission element array.

The structures and manufacturing methods of longitudinal type electron emission elements using such minute particles have been reported/developed in J. Vac. Sci. Technol. B14 (1996)2060, U.S. Pat. No. 5,019,003, Japanese Laid-open Patent Application No. Hei-8-241665, Japanese Laid-open Patent Application No. Hei-8-77916, Japanese Laid-open Patent Application No. Hei-10-92294 and Japanese Laid-open Patent Application No. Hei-10-92298.

J. Vac. Sci. Technol. B14(1996)2060 discloses the following technique. According to this technique, an emitter line layer (4002), an insulating film (4001) and a gate film (4003) are deposited on a substrate, and plural holes are formed so as to pierce through the gate film and the insulating film. Further, diamond fine particles (particle diameter of about 1 $\mu$m) doped with nitrogen are etched to roughen the surfaces thereof, and then dispersed and pasted in conductive matrix. Thereafter, the paste (4005) thus obtained is filled into the holes on the substrate by a squeegee (4004) to form an electron emission element as shown in FIG. 7. However, the emitter line layer and the gate film of the element thus formed are structurally liable to be short-circuited by a conductive base material and thus it is low in reliability.

The specification of U.S. Pat. No. 5,019,003 discloses an emitter having such a structure that a plurality of fine particles (diameter of 1 $\mu$m) are fixed on a substrate 100 by binding agent 101 as shown in FIG. 8. This structure is characterized in that the sharp corners of the fine particles project from the binding agent. Conductive fine particles 201 or insulating fine particles 203 covered by a conductive film 202 may be used as the fine particles. Mo, TiC or the like may be used as the conductive material. The specification of this patent also discloses the arrangement of a gate and anodes for extracting electrons to constitute an electron emission element. In this arrangement, plural fine particle emitters 201 provided on the substrate are covered by an insulating film 409 and gates 401 are arranged on the insulating film 409 as shown in FIG. 9. Further, an insulating film 402 is disposed on the gates 401, and a transparent face plate 404 having a function as an anode electrode and a phosphor layer 403 are disposed on the insulating film 402.

In reality, however, it is not easy to uniformly provide plural fine particles over a large area by the method as disclosed in the above U.S. patent. In order that lots of electrons are emitted, the sharp corners of the fine particles are put face sides up. However, the probability that the sharp corners of the fine particles are put face up is not high, and most of particles do not function as emitters.

In general, the distribution of such parameters as geometric enhancement factors among respective electron emission elements results in much broader distribution of the electric-field/current density characteristics, due to the non-linearity of the field emission. Particularly in a case where an application of the electron emission elements to a display is assumed, the characteristics must be uniform among pixels when the elements are added with gates and fabricated as an array.

Accordingly, it is required that plural electron emission elements constituting pixels should have substantially the same characteristic distribution among the pixels. Therefore, in order to make the characteristic distribution uniform among the pixels, it is necessary that a lot of electron emission elements are contained in each pixel so that the averaging effect can be sufficiently exhibited.

When the size of each pixel is equal to about several hundreds mm square, the maximum number of gate opening portions which can be placed within each pixel is equal to several thousands. However, if the fraction of electron emission elements which do not operate due to unevenness of the arrangement and direction of fine particles is not sufficiently low, the averaging effect is remarkably lowered to the extent that it causes non-uniformity of display which is not allowed in a display.

In addition, the fine particle emitters 201 are located underneath the insulating film in the structure shown in FIG. 9, so that dielectric breakdown is liable to occur in this structure. The thickness of the insulating film must be increased to achieve a sufficient withstanding voltage, and thus the operating voltage rises up.

The Japanese Laid-open Patent Application No. Hei-8-241665 also discloses electrode emission elements using fine particles having the same structure. However, this publication uses as the fine particle material diamond particles activated by hydrogen plasma. The fine particle material of this publication has no specific direction in which electrons are more liable to be emitted, and electron emission occurs from many fine particles. Further, the particle diameter is small (ranging from 10 to 300 nm), so that a large number of fine particles can be placed within an unit area and the averaging effect can be effective. In the structure shown in FIG. 10, a plurality of diamond particles 53 are disposed on a conductive surface 52 provided on a substrate 51, and mask particles 62 are disposed on the diamond particles 53. Thereafter, an insulating film 60 and a gate film 61 are deposited while the mask particles 62 function as masks. This structure still has the problem in dielectric breakdown, and any method of forming a fine particle film uniformly is not disclosed.

In the case of the Japanese Laid-open Patent Application No. Hei-8-77916, an emitter line layer 932 is disposed on a substrate 901 and a conductor 940 containing emitter fine particles 938 is disposed on the emitter line layer 932 through a conductive spacer layer 936 as shown in FIG. 11. The conductor 940 is formed by combining a deposition method such as a sputtering method. An insulating layer **914*b* and a gate film 907*b* are provided so as to surround the conductor 940** containing the emitter fine particles.

In this structure, the reliability of the insulating film is improved because the emitter material does not extend into underneath the insulating film unlike the structure described above. However, the deposition process and the patterning process are used to form electron emission elements, and thus the size of the array of the electron emission elements which can be fabricated is limited by the size of a deposition apparatus and an exposing apparatus as in the case of the Spindt method.

Further, according to the method disclosed in this publication, some portions of the insulating film and the gate film which are located above the electron emission portions are removed by using lift-off of the resist when the insulating film and the gate film are disposed. However, it is technically difficult to perform this method because the sum of the film thickness of the insulating film and the gate film is close to 1 $\mu$m. Therefore, the yield is low and this method is unsuitable for manufacturing a large-area electron emission element array.

In the case of the Japanese Laid-open Patent Application No. Hei-10-92294, an insulating layer 1003 and a gate electrode line 1004 are disposed on a lower substrate 1001 and a cathode electrode line 1002. Further, an opening portion 1005 is provided and fine particle emitter material is injected from a nozzle into the opening portion 1005 together with high-pressure gas to form a thin film 1007. In this method, however, it is difficult to adjust the amount of fine particles deposited in the opening portion and non-uniformity of display is liable to occur when the electron emission elements thus formed are applied to a display. In addition, the gate and the emitter are liable to be short-circuited in the process of forming the electron emission element.

The common problem in the examples of the electron emission elements using the fine particles described above resides in that when these elements are applied to a display, it is required that the maximum amount of current emitted from the electron emission elements within each pixel cannot be limited. This requirement must be satisfied to suppress occurrence of unevenness in brightness. Accordingly, it is required that an element for limiting the maximum current is installed in each pixel, preferably in each electron emission element. However, any conventional technique described above does not install any structure for limiting the current.

An electron emission source and a display device using the electron emission source disclosed in Japanese Laid-open Patent Application No. Hei-10-92298 are known as a display device using electron emission elements, for example, an extremely thin type display device. The electron emission source and the display device described above will be described with reference to FIGS. 13 and 14.

In the conventional electron emission source, a plurality of stripe-shaped cathode electrode lines 5002 are formed on the surface of a lower substrate 5001 formed of glass material, and a thin film 5007 of material having a small work function is formed on these cathode electrode lines 5002. Further, an insulating film 5003 is formed on the thin film 5007, and a plurality of stripe-shaped gate electrode lines 5004 are formed on the insulating layer 5003 so as to cross the respective cathode electrode lines 5002. The cathode electrode lines 5002 and the gate electrode lines 5004 are formed in a matrix structure. Each cathode electrode line 5002 and each gate electrode line 5004 are connected to control means 5015 to control the driving operation thereof.

In each cross area between the cathode electrode line 5002 and the gate electrode line 5004, a lot of substantially circular holes 5005 are formed so as to pierce through the gate electrode line 5004 and the insulating layer 5003 and extend to the thin film 5007, and the thin film 5007 at the bottom portions of these holes 5005 form a cold cathode.

FIG. 14 shows a display device using this electron emission source. The display device 5020 comprises an electron-emission member having a number of electron emission sources 5012 arranged so as to constitute a display screen, and an upper substrate 5028 disposed so as to be spaced from the electron-emission member at a predetermined interval in the electron emission direction. Stripe-shaped luminescent plates 5029 coated with phosphor which are arranged in parallel to the gate electrode lines 5024 are formed on one surface of the upper substrate which faces the electron emission sources 5012. The gap between the electron emission sources 5012 and the luminescent plate 5029 are kept under vacuum.

Next, the driving operation of the display device 5020 thus fabricated will be described. When the control procedure selects one of the cathode electrode lines 5022 and one of the gate electrode lines 5024 and applies a predetermined voltage across them, electrons are emitted from the electron emission source 5012 at the cross area between them. Further, the electrons are accelerated by a voltage applied across the cathode electrode line 5022 and the upper substrate 5028 serving as the anode, and hit the phosphor on the luminescent plate 5029 to emit visible light, thereby forming an image.

The cross area between the cathode electrode line 5002 and the gate electrode line 5004 constitutes a capacitor using an insulating layer as a dielectric layer. The electrostatic capacitance (parasitic capacitance) Q of the capacitor is represented as follows:

$$Q=\epsilon_O\times\epsilon\times A/d \quad (1)$$

$\epsilon_0$: the permeability of vacuum $\epsilon$: the permeability of the insulating layer A: the area of the cross area d: the thickness of the insulating layer Therefore, the power W consumed at the capacitance portion under the driving operation is represented as follows:

$$2W=2pfQV2 \quad (2)$$

f: driving frequency

V: driving voltage between gate and emitter

In a conventional light emitting element and a display device using the light emitting element, $SiO_2$ is generally used as the material of the insulating layer 5003. The dielectric constant of the $SiO_2$ thin film formed by CVD or the like is equal to about 4.3, and the parasitic capacitance expressed by the equation (1) is increased to the extent that it cannot be ignored, so that the consumption power of the display device is increased. Further, the thickness of the insulating layer must be increased to suppress the parasitic capacitance within a permissible range, and thus there occurs such a problem that the distance between the gate and the emitter must be increased, resulting in increase of the driving voltage.

As described above, in the conventional electrode emission elements, the structure of the element is simplified by forming the electron emission element of fine particle material, and a high-cost vacuum film forming process can be replaced by a non-vacuum process. However, the conventional techniques have such problems that the reliability of the insulating film cannot be sufficiently ensured from the structural viewpoint and the short-circuiting between the gate wire and the emitter wire occurs.

Furthermore, the conventional techniques have a problem in that the current flowing in each emitter is not limited because the uniformity of display must be kept when the electron emission elements are applied to a display, In addition, there has not been achieved any method which can suppress occurrence of unevenness/defects over a large area without using a vacuum process and uses fine particles uniformly.

SUMMARY OF THE INVENTION

Therefore, an object of the present invention is to provide an extremely thin type display device with large picture forming area and long lifetime which can be operated with a low voltage.

According to the present invention, there can be implemented the structure of electron emission elements which has high reliability of insulation between a gate film and an emitter film and has a function of limiting the amount of current emitted from each emitter. Further, a number of the elements can be uniformly manufactured over a large area by using a non-vacuum process.

According to the structure of the electron emission element and the manufacturing method of the electron emission element of the present invention, there can be manufactured an electron emission element array which limits the emission amount of electrons from each emitter and has a uniform characteristic over a large area. Further, electron emission elements using lots of fine particles can be formed over a large area with suppressing occurrence of unevenness/defects by using the non-vacuum process. In addition, the short-circuiting between the gate wire and the emitter wire can be suppressed in the formation process of the electron emission elements.

According to the present invention, there can be achieved a sufficient current limiting effect which is inherent to a resistance layer comprising an insulator and a conductor dispersed in the insulator. Accordingly, when electron emission elements using fine particles are applied to a large-scale display, unevenness of display and occurrence of pixel defects can be effectively suppressed.

Furthermore, by applying the formation method of the elements to an electrophoresis method, the resistance layer and the fine particle layer can be uniformly and selectively deposited on the emitter wire within the gate opening portion, so that the short-circuiting between the gate and the emitter can be suppressed and the reliability of the operation can be remarkably enhanced.

The present invention provides a field emission element comprising: a board; a cathode layer formed on said board; an insulating layer formed on said cathode; a gate layer formed on said insulating layer; a resistance layer formed on said cathode in an opening of said insulating layer and said gate layer, said resistance layer consisting of conductive particles and resistance particles; and an emitter layer formed on said resistance layer, said emitter layer consisting of particles.

The present invention also provides a field emission display comprising; a board; a cathode layer formed on said board; an insulating layer formed on said cathode; a gate layer formed on said insulating layer; a resistance layer formed on said cathode in an opening of said insulating layer and said gate layer, said resistance layer consisting of conductive particles and resistance particles; an emitter layer formed on said resistance layer, said emitter layer consisting of particles; an anode layer opposite said board; and a luminescent layer on said anode layer.

Further, the present invention provides a method for manufacturing a field emission display comprising: forming a cathode layer on a board; forming an insulating layer on said cathode; forming a gate layer on said insulating layer; forming an open in said insulating layer and said gate layer; forming a resistance layer on said cathode in said open by electrophoresis, said resistance layer consisting of conductive particles and resistance particles; and forming an emitter layer on said resistance layer by electrophoresis, said emitter layer consisting of particles.

DETAILED DESCRIPTION OF THE PREFERRED EMBODIMENTS

Electron Emission Element

A preferred embodiment of an electron emission element of the present invention will be described.

Figure 1:
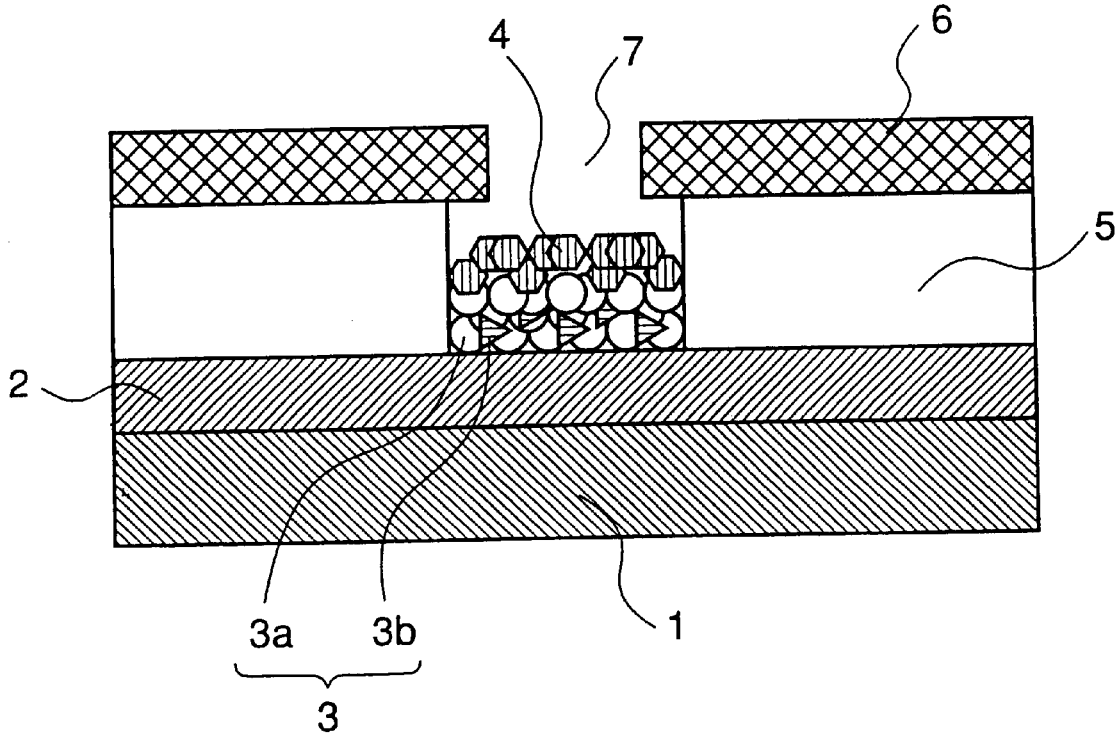
FIG. 1 is a schematic diagram showing an example of the structure of an electron emission element of the present invention.

FIG. 1 is a schematic diagram showing an example of the structure of an electron element of the present invention. In FIG. 1, reference numeral 1 represents a substrate, reference numeral 2 represents a cathode electrode line layer, reference numeral 3 represents a resistance layer, reference numeral 4 represents an emitter fine particle film, reference numeral 5 represents an insulating layer, reference numeral 6 represents a gate wiring layer and reference numeral 7 represents an opening portion.

The substrate 1 is formed of any material selected from the group consisting of a laminate obtained by coating an insulating film of $SiO_2$ or the like on the surface of quartz glass, Pyrex glass, soda lime glass or stainless, an aluminum plate coated with a barrier type anode oxidizing film and Si wafer. When an application to a display is assumed, it is preferable that the material is hardly deformed and has a thermal expansion coefficient near to the front plate of the display, and it is suitably selected in consideration of factors such as cost, etc.

An emitter line layer 2 is formed on the substrate 1. In general, conductor materials can be used as the material of the emitter line layer 2. For example, it may consist of metal such as Ni, Cr, Cu, Au, Pt, Ir, Pd, Ti, Al, Mo, W or the like, or alloy thereof, and preferably it may be formed of a material having low resistance, high thermal conductivity and high melting point. The film thickness of the emitter wire layer 2 is set to about 100 nm to 50 $\mu$m, preferably about 500 nm to 20 $\mu$m. The emitter wire layer 2 is formed by a deposition method such as a sputtering method or the like, preferably by a printing method or a plating method.

An insulating layer 5 and a gate line layer 6 are provided on the emitter line layer 2, and an opening portion 7 is partially provided. A film of $SiO_2$, $Al_2O_3$, MgO, $Ta_2O_5$ or the like may be used for the insulating film 5, and it is formed by various methods such as a vacuum-deposition method (a sputtering method, etc.), a liquid-phase growth method (LPD method, etc.), an anodizing method, etc. Of these methods, the LPD method can provide insulating films conveniently by liquid phase growth. Therefore, the $SiO_2$ film formed by the LPD method is preferably used. Even when no film can be formed on the emitter line layer 2 due to selectivity of a back film under use of the LPD method, the LPD method can be applied by forming the back film of $SiO_2$ in advance with a CVD method or the like.

A conventional conductor material can be used for the gate line layer 6. The film thickness thereof is set to about 100 nm to 5 $\mu$m, preferably about 200 nm to 1 $\mu$m. As in the case of the emitter line layer, it may be formed of metal such as Ni, Cr, Cu, Au, Pt, Ir, Pd, Ti, Al, Mo or W, or alloy thereof. Preferably, a material having low resistance, high thermal conductivity and high melting point may be selectively used, and the deposition method such as the sputtering method or the like, preferably the print method or the plating method can be used. It is necessary to pay attention to adhesiveness to the back film. When sufficient adhesiveness to the back film is not achievable, it is preferable to form an extremely thin film of metal of Ti or Cr between the gate wiring layer 6 and the back film as an adhesive layer. In place of use of the adhesive layer, the surface of the insulating film can be made sufficiently hydrophobic by using an anneal treatment under hydrogen atmosphere.

The opening portion 7 penetrating through the gate wiring layer 6 and the insulating layer 5 is substantially circular. The diameter thereof ranges from 200 nm to 10 $\mu$m, and preferably within the range from 500 to 2 $\mu$m. The opening portion 7 can be formed by a patterning treatment after the insulating layer 5 and the gate wiring layer 6 are formed. A sacrificial layer which is formed before the insulating layer 5 and the gate wiring layer 6 are formed and dissolved after the gate wiring layer 6 is formed is provided in advance, and lift-off procedure is carried out.

The resistance layer 3 and the emitter fine particle layer 4 are provided in the opening portion. In the resistance layer 3, conductive fine particles 3*b* may be dispersed in an insulating base material 3*a*. Inorganic materials such as $SiO_2$ or the like, organic materials such as Teflon or the like may be used as the insulating base material 3*a*. Of these materials, fine particle material of polyimide is preferably used. The particle diameter is preferably equal to 5 nm to 500 nm, more preferably to 5 nm to 50 nm. The organic materials such as polyimide or the like are remarkably liable to adsorb water, and desorbs the water thus adsorbed under the vacuum. Therefore, it is generally unsuitable for the use under the vacuum. However, the amount of the organic material used in the structure of the present invention is extremely small, and it is practically usable without any obstruction. Particularly when the organic particles are used, they are preferably used after subjected to a sufficient gas discharging process.

General metal material or carbon-based material may be used for the conductive fine particles 3*b*. When polyimide fine particles are used for the insulating base material 3*a*, the carbon-based material is more preferable because it can be more uniformly dispersed in the base material. As the carbon-based material may be used graphite fine particles, amorphous carbon fine particles, fullerenes, carbon nanofiber, graphite nanofiber or the like.

Diamond particles or fine particle materials having extremely small electron affinity such as boron nitride of cubic system (c-BN), boron nitride of hexagonal system (h-BN), aluminum nitride (AlN), etc. may be used for the fine particle emitters 4 used in the present invention. Further, fine particle materials of oxide material such low work function materials as $CeO_2$, $Ho_2O_3$ or carbides such as HfC, ZrC, SiC or the like may be used.

The particle diameter of these fine particle materials is set to 5 nm to 500 nm, preferably ranging from 5 nm to 50 nm.

It is preferable that the diamond fine particles or fine particle materials of boron nitride of cubic system (c-BN), boron nitride of hexagonal system (h-BN) or aluminum nitride (AlN) are subjected to an activating treatment before they are used. In the case of diamond, it is preferably subjected to a hydrogen plasma treatment, or an oxygen plasma treatment and a hydrogen annealing treatment. In the case of c-BN and h-BN, it is preferable that they are subjected to the hydrogen plasma treatment, the oxygen plasma treatment and the hydrogen annealing treatment, or the hydrofluoric acid treatment. In the case of AlN, it is preferably subjected to the hydrogen plasma treatment, the oxygen plasma treatment and the hydrogen annealing treatment, the hydrofluoric acid treatment or an alkali treatment. These materials are preferably doped into n-type or p-type, and more preferably doped into n-type.

In the case of diamond, it is preferable that substitutional nitrogen doping is conducted, and in the case of c-BN, it is preferable that sulfur-doping is conducted.

Figure 2:
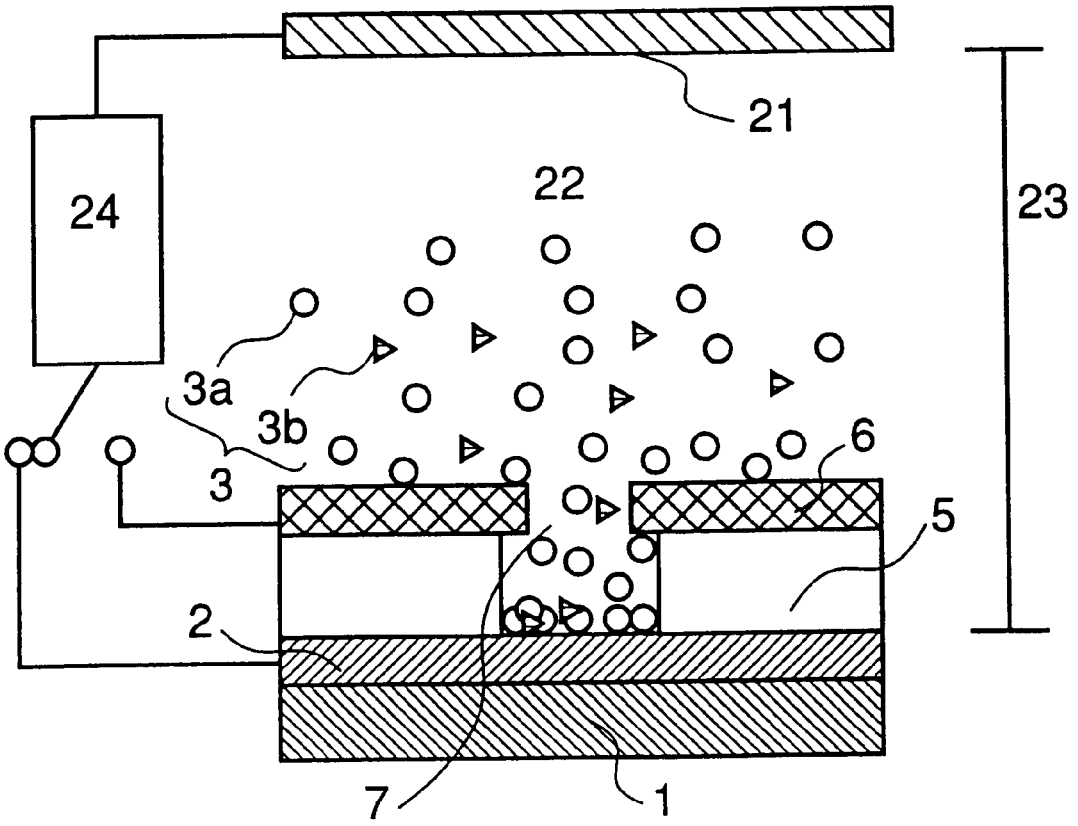
FIGS. 2(*a*) and 2(*b*) are schematic diagrams showing a method of forming a resistance layer and a fine particle emitter layer in the electron emission element of the present invention.
Figure 2:
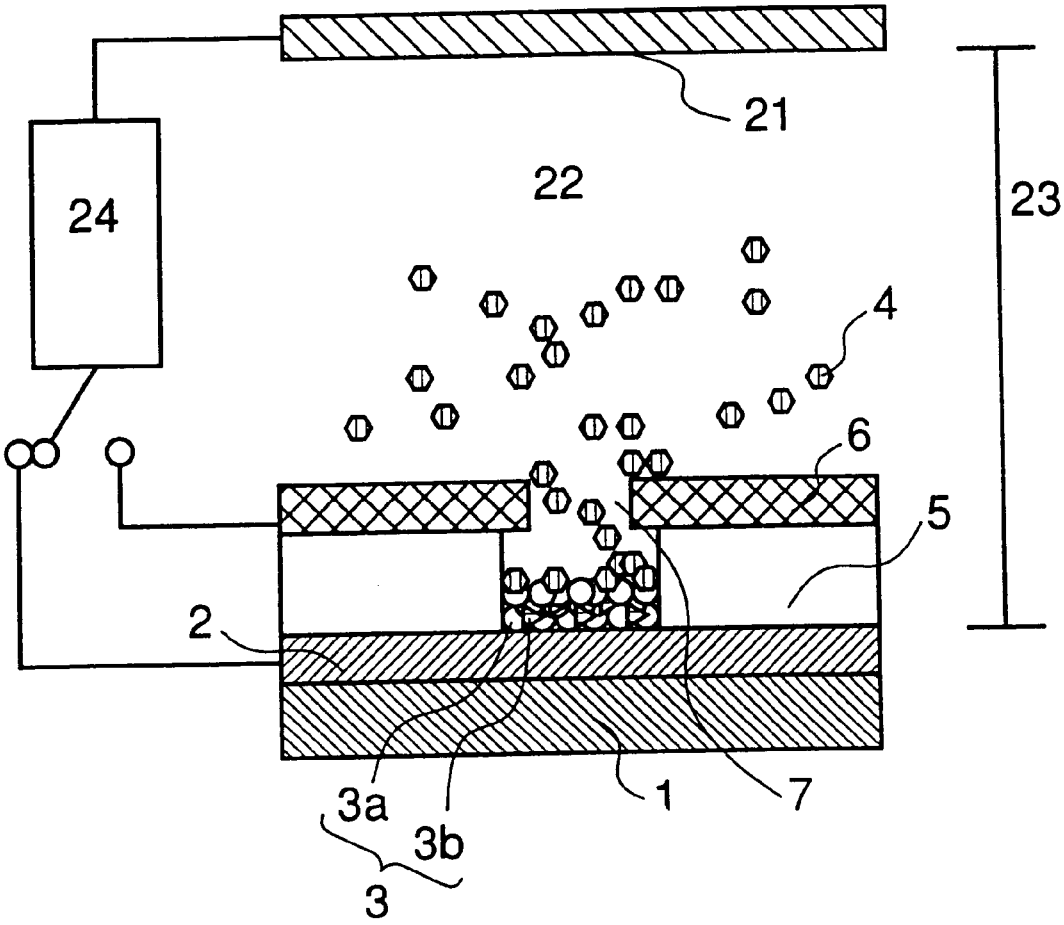

Next, the method of manufacturing the electron emission element according to the present invention will be described with reference to FIGS. 2(*a*) and 2(*b*). FIGS. 2(*a*) and 2(*b*) are diagrams showing a method of forming the resistance layer 3 and the fine particle emitter layer 4. The reference numerals 1 to 7 used in FIGS. 2(*a*) and 2(*b*) correspond to those of FIG. 1. Reference numeral 21 represents a counter electrode used in the film forming process, reference numeral 22 represents dispersing solvent for the fine particle material, reference numeral 24 represents voltage applying means used in the film forming process, and reference numeral 23 represents the interval between the counter electrode and the substrate of the electron emission element. Not shown is the container in which the above elements are placed.

In the present invention, both the resistance layer 3 and the fine particle emitter layer 4 are preferably deposited and formed by electrophoresis, and thus the arrangements in FIGS. 2(*a*) and 2(*b*) are the same. The spacing 23 between the counter electrode and the substrate of the element, the dispersing solvent 22 and the voltage to be applied by the voltage applying means 24 are determined in consideration of the conditions described below.

That is, electrophoresis is a technique of immersing a pair of electrode plates facing each other in solvent and applying a voltage between the electrode plates. Here, the fine particles are dispersed in the solvent, and the dispersing solvent is insulating. The fine particles are attracted to one electrode plate and deposited thereon by the voltage applied across the electrode plates. The application of the voltage induces electric field in the solvent, and the charged fine particles are moved by the electric field. Normally, the material is charged in solvent due to the effect of $\zeta$ potential owned by the material itself; however, the amount of charge the charged material carries is insufficient to perform the electrophoresis. Therefore, the fine particles are usually artificially charged by adding metallic salt into the solvent, and zirconium naphthenate, magnesium naphthenate or the like may be used as the metallic salt.

The condition that electrophoresis occurs is dependent on the dielectric constant of the solvent, the dielectric constant of the fine particles, the mobility of the fine particles in the solvent and the charge of the fine particles; the intensity of electric field needed to induce electrophoresis is equal to about 1000 V/mm.

Here, it is noted that the term electrophoresis is often confused with dielectrophoresis. Dielectrophoresis is a technique which does not move charged fine particles by applying electric field, but moves polarized fine particles by the grade of electric field. Accordingly, an alternating electric field is usable in dielectrophoresis, and the intensity of electric field may be set to about 1 V/mm. Both electrophoresis and dielectrophoresis are described in detail in "Encyclopedia of Science and Technologies" issued by Nikkan Kogyo Shinbun Co., Ltd. (1996) and in other papers.

Accordingly, in order to use the film forming method for the resistance layer and the fine particle film by using electrophoresis, it is sufficient to set the ratio of the voltage (V) and the interval (mm) between the counter electrode and the element substrate to about 1000 V/mm. Preferably, the voltage ranges from 100 V to 500 V, and the spacing ranges from 100 $\mu$m to 500 $\mu$m. For example, when the voltage applied across the counter electrode and the element substrate is set to 150 V, the distance between the two may be set to 150 $\mu$m.

In the method of forming the electron emission element of the present invention, the resistance layer 3 is first formed by electrophoresis as shown in FIG. 2(*a*). At this time, insulating organic solvent may be used as the dispersing solvent and, for example, isoparaffin is preferable.

In this case, the mixture of insulating base material and conductive fine particles which are mixed in a ratio of (insulating base material): (conductive fine particles)=100:1 to 100000:1 is dispersed in solvent so that the weight ratio of (insulating material+conductive fine particles) in the solvent is equal to about 10 to 0.1%. Further, metallic salt is dissolved in solvent in a weight ratio of about 1 to 0.01%.

When a voltage is applied across the counter electrode 21 and the emitter wire 2 by the voltage applying means 24, the charged fine particles are moved to induce current flow, and the current thus induced is gradually reduced. Here, the positive/negative sign of the voltage thus applied is dependent on the positive/negative sign of the charges of the charged fine particle materials. When the metallic salt is added, the fine particles are charged positively, and thus the bias voltage is applied so that the emitter wire 2 is negative. Only a small amount of salt adheres to the particles, having little effect on the character of the particle. When the current is sufficiently reduced, the application of the voltage is stopped.

Further, it is preferable to add a step of applying a positive bias across the gate layer 6 and the counter electrode 21 immediately after the application of the voltage is stopped, thereby removing the resistance layer deposited on the gate layer. It is further preferable that means for applying ultrasonic wave is installed in the arrangement of FIG. 2(*a*) in order to keep dispersion of the fine particles.

It is still further preferable that after the resistance layer 3 is selectively deposited on the emitter line layer in the opening portion 7 by the above method, an anneal treatment is carried out under vacuum or an inert atmosphere. The anneal temperature is preferably set between about 200° C. to 400° C.

The resistance layer 3 is formed to a thickness of about 200 nm to 500 nm as described above.

Finally, the fine particle emitter film is deposited as shown in FIG. 2(*b*). The film forming method at this time is the same as the film deposition method of the resistance layer described above. However, the fine particle emitters 4 are dispersed in the solvent. The film thickness of the fine particle emitter film thus formed is preferably set to the level of about one layer to two layers.

Display Device

A display device of the present invention includes a first substrate on which cathode electrode lines, an emitter layer, an insulating layer and gate electrode lines crossing the cathode electrode lines are formed in this order, and a second substrate which comprises an anode wiring layer and a phosphor layer and is disposed away from the first substrate through vacuum so as to confront the first substrate. Here, the display device is characterized in that the insulating layer on the first substrate is formed of an $SiO_2$ film containing fluorine.

In the present invention, since the insulating layer of $SiO_2$ on the first substrate preferably contains fluorine, an insulating layer having a remarkably low dielectric constant can be achieved. The dielectric constant of an $SiO_2$ film formed by a normal thin film forming method which is represented by the chemical vapor deposition method (CVD) or the high-frequency sputtering method is equal to about 4.3. On the other hand, the dielectric constant of the insulating layer of the present invention is equal to 4.0 or less.

Figure 3:
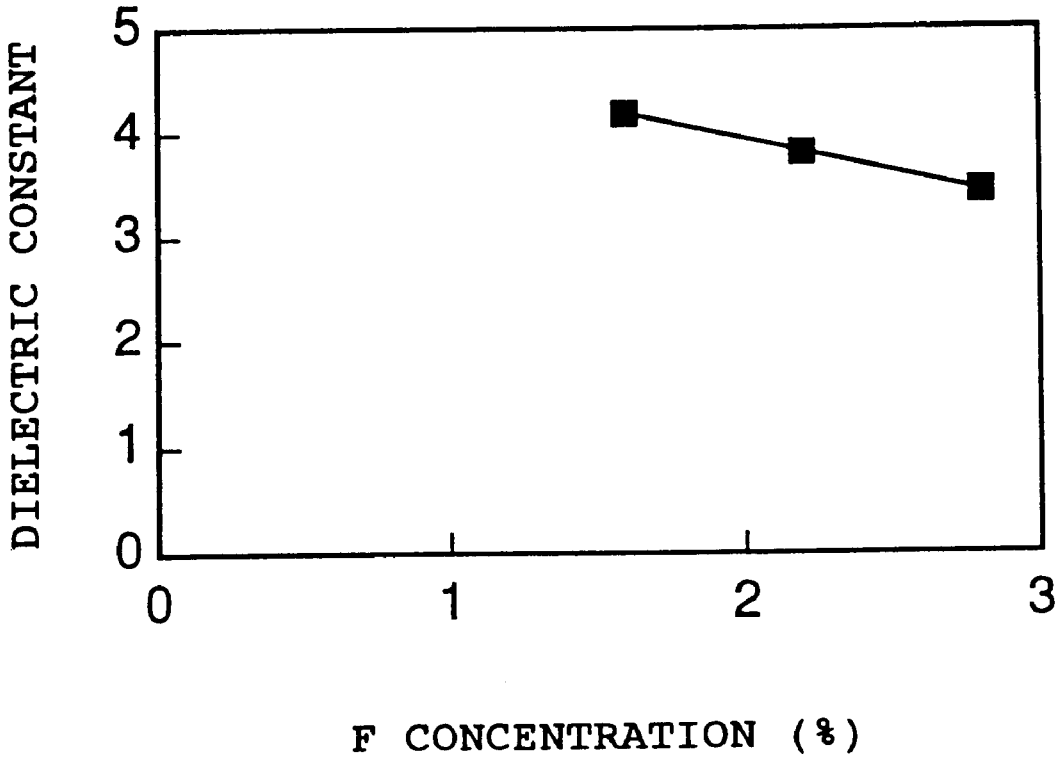
FIG. 3 is a graph showing the relationship between the fluorine concentration and the dielectric constant in $SiO_2$ thin film containing fluorine in the present invention.

FIG. 3 shows the relationship between the concentration of fluorine and the dielectric constant of the $SiO_2$ film formed by the liquid phase deposition method. As shown in FIG. 3, the dielectric constant is reduced as the fluorine content increases.

Upon estimating the dielectric constant required to the insulating layer, in the case of a conical type emitter in a diode-type structure having Parallel flat plates, about 1000 $\mu$m is required as the electric field between the emitter and the gate which induces electron emission sufficient to excite the phosphor on the face plate.

Further, when the cold cathode is formed of fine particles like the present invention, the electric field is concentrated more locally as compared with the parallel flat plate structure, and the intensity of the concentrated electric field is about 100 times as large as the conical type emitter. Accordingly, the minimum electric field which is actually required between the gate and the emitter is estimated to be equal to one hundredth of 1000V/$\mu$m, that is, 10V/$\mu$m.

In order to use this display device as a wall-suspended television for households, the consumption power is required to be less than 200W, and the driving voltage between the gate and the emitter must be reduced down to 100V or less. In order to apply 10V/$\mu$m to the emitter provided in the gate when the voltage between the gate and the emitter is equal to 100V, about 1 $\mu$m or less is needed to be set. These values are examples, and they are actually dependent on the structure between the gate and the emitter.

From the viewpoint of the power consumption efficiency, the parasitic capacitance between the gate and the emitter is required to be equal to about 5 pF or less per pixel. This means that the parasitic capacitance is equal to 1.67 pF per dot for the following reason. When a display is driven, the charging/discharging of the parasitic capacitors is carried out in each pixel. Under the condition that the number of pixels is equal to about 2000×1000×3 and the rewriting frequency per second is equal to about 100 times, the number of parasitic capacitors which are charged/discharged per second is equal to about $6\times10^8$ at maximum. When 100V is applied to each parasitic capacitor to charge the parasitic capacitor, the energy required to charge/discharge each parasitic capacitor once is equal to 5000×Q joules, where Q represents the parasitic capacitance of each parasitic capacitor. Therefore, the power consumed by the parasitic capacitors is equal to $3\times10^{13}$. If the total power consumption is below 200W, the power consumption by the electrostatic capacitance can be suppressed to about 10%. Accordingly, the electrostatic capacitance at each dot is equal to $20/3\times10^{13}$ (about 5 pF). Assuming that the space between the pixels is equal to 3.5 $\mu$m, the size of each dot is equal to 415 $\mu\times115$ $\mu$m and the area is equal to $4.77\times10^{-8}$ $m^2$. From the equation and the following equation: A=4.77E-8m2, Q<1.67 pF, $$\epsilon/d<3.95\times10^5 m^{-1} \tag{3}$$

where $\epsilon$ represents the dielectric constant required of the insulating layer. Since the distance between the gate and the emitter which is required to induce emission of the electrons is equal to 1 $\mu$m at maximum, by using $d=10\times10^{-6}$m, $$\epsilon<3.95 \tag{4}$$

The low dielectric constant expressed by equation (4) is not achievable by the normal $SiO_2$ film, and it can be achieved by adding fluorine to the $SiO_2$ film. From the equation (4) and FIG. 3, it is preferable that the concentration of fluorine contained in the $SiO_2$ film is equal to 2% or more.

Next, an embodiment of an electron emission element according to the present invention will be described.

Figure 4:
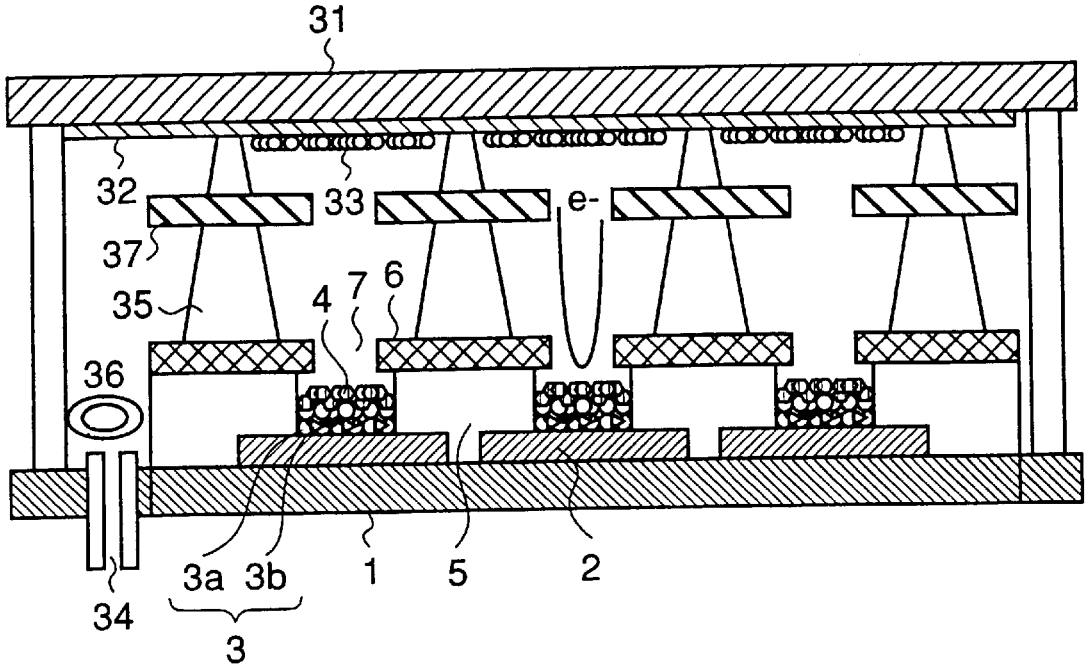
FIG. 4 is a schematic diagram showing an application of the electron emission element of the present invention.

The basic construction of the electron emission element used in the display device is the same as shown in FIG. 1. FIG. 4 shows the structure of a display device to which the present invention is applied. In FIG. 4, reference numeral 31 represents a face plate, reference numeral 32 represents an anode electrode for accelerating electrons emitted from the electron emission elements, reference numeral 33 represents a phosphor, reference numeral 34 represents an exhaust pipe, reference numeral 35 represents a spacer for supporting the outside air pressure, reference numeral 36 represents a getter for adsorbing residual gas, and reference numeral 37 represents a focus electrode for focusing electron beams onto pixels. The reference numerals 1 to 7 are the same as used in FIG. 1. That is, reference numeral 1 represents a substrate, reference numeral 2 represents a cathode wiring layer, reference numeral 3 represents a resistance layer, reference numeral 4 represents an emitter fine particle film, reference numeral 5 represents an insulating layer, reference numeral 6 represents a gate line layer and reference numeral 7 represents an opening portion.

The first preferred embodiment of a method of manufacturing an electron emission element array according to the present invention will be described.

(Step 1)

There is prepared a rectangular Pyrex glass substrate 1 of 14 inches in diagonal length and about 5 mm in thickness, whose surface is roughened by a plasma treatment. Usually, a laterally elongated screen (having long sides in the lateral direction and short sides in the longitudinal direction) is formed. In this embodiment, a laterally elongated screen will be described; however, the direction of the screen and the direction of the emitter lines 2 on the screen may be suitably selected.

The emitter line layers 2 are formed with intervals of about 450 $\mu$m in a direction perpendicular to the long-side direction of the substrate 1, that is, in the longitudinal direction. However, a margin for leading out lines is provided in a 2-inch area at the outside of the emitter line 2 which is located at each of both the ends of the short sides, that is, both the lateral edge portions of the substrate 1. The patterning is carried out so that nothing is formed on these margins. The width of the emitter wires 2 is set to about 350 $\mu$m.

The emitter lines 2 are formed as follows. First, a PVA (poly-Vinyl-Alcohol) film is coated on the substrate 1, and the patterning using ultraviolet-ray irradiation is carried out with an exposing mask, whereby a mask is formed on a portion at which no emitter line 2 will be formed. Subsequently, an Ni film of about 50 nm is grown by electroless plating. At this time, the patterning precision is set to about 15 $\mu$m. Then, the PVA film is subjected to lift-off.

The Ni film formed by the electroless plating is subjected to electrolytic plating as an electrode to grow an Au film of about 1 $\mu$m on the Ni film.

(Step 2)

The $SiO_2$ film 5 is grown at a thickness of about 1 $\mu$m by using the LPD (Liquid Phase Deposition) method. The LPD film thus grown may contain lots of particle defects. However, if the density of the defects is equal to about 1000/cm$^2$, no serious problem occurs practically. In the prototype, the film formed on Au is slightly cloudy with black; however, it has a breakdown voltage in excess of 100 V per $\mu$m. This value is large enough to the extent that it does not obstruct practical use. The $SiO_2$ film 5 conformally covers the step portions of the Au—Ni wiring line layers, so that there exists no exposed portion of Au.

(Step 3)

Pd electroless plating is conducted on the $SiO_2$ film 5 to form a Pd film of about 30 nm, and then an Ir film is grown at a thickness of about 200 nm by the electrolytic plating, thereby forming the gate film.

(Step 4)

Subsequently, the gate film is subjected to patterning in the long-side direction of the substrate, that is, in the lateral direction to form the gate wires 6. The emitter wires 2 and the gate lines 6 are arranged so as to cross each other in the vertical direction. The pitch of the gate wires 6 is set to about 150 $\mu$m, and the width of each gate line 6 is set to about 110 $\mu$m. A margin for leading out the lines is provided in a 2-inch area at each of both the long-side edge portions, that is, the upper and lower ends of the substrate. The patterning is carried out so that no gate line 6 is formed on the margin portions. The patterning precision is set to about 15 $\mu$m for the emitter lines.

As in the case of the step 1, the patterning is carried out by using photo-polymerization of PVA. In this case, PVA is coated on only the gate wires 6, and the remaining exposed portion is removed by etching.

(Step 5)

Subsequently, another patterning treatment is carried out to form a substantially circular opening portion 7 at the crossing portion between each emitter line 2 and each gate line 6 so that the opening portion 7 pierces through the gate layer 6 and the insulating layer 5.

There are two reasons for performing the above patterning treatment separately from the patterning treatment for the gate layer 6. One reason resides in that since the diameter of the opening portion is equal to about 1 $\mu$m, it is necessary to use patterning means which has an optical resolution of about 1 $\mu$m. The other reason resides in that the opening portions 7 are not necessarily provided at a fixed interval on the crossing portion between the emitter line 2 and the gate line 6, and it is sufficient if the opening diameter is uniform and substantially the same number of opening portions are arranged on each crossing portion. Optical lithography or a patterning treatment using a phase-separation structure of polymer may be used as the patterning method having such a resolution.

The phase separation structure of polymer is defined as the following phenomenon. Two different polymers A and B are mixed with each other. When the mixture is heated up to a sufficiently higher temperature than the glass-transition temperatures of both the polymers A and B, the mixture segregates into two portions, one portion where the concentration of the polymer A is higher and the other portion where the concentration of the polymer B is higher. In this case, there appears such a structure that a lot of "islands" where the concentration of the polymer B is higher are dispersed in the "sea" where the concentration of the polymer A is higher, or vice versa. The size of "islands" thus formed is almost equal to about 1 $\mu$m in diameter because of thermodynamic stability, so that this method is suitable for the patterning of the opening portion 7.

In this embodiment, the crossing portions between the gate lines 6 and the emitter lines are protected by the patterning of resist (produced by Tokyo Applied Chemistry Company: OFPR800, 100 cp).

Further, a polymer A insoluble in developing liquid (IPA: isopropyl alcohol) and a polymer B soluble in the developing liquid are mixed and solved at a mixing ratio of 7:3 in an organic solvent (PGMEA: propylene glycol mono-ethyl ether acetate). For example, PS (polystyrene, produced by Sanyo Applied Chemistry Company: molecular weight of 2100) may be used as the polymer A, and PNBMA (propylene glycol mono-ethyl ether acetate) may be used as the polymer B.

This solution is coated on the substrate by a doctor blade method. The film thickness when the organic solvent is vaporized is equal to about 4 $\mu$m just above the gate lines 6.

Figure 5:
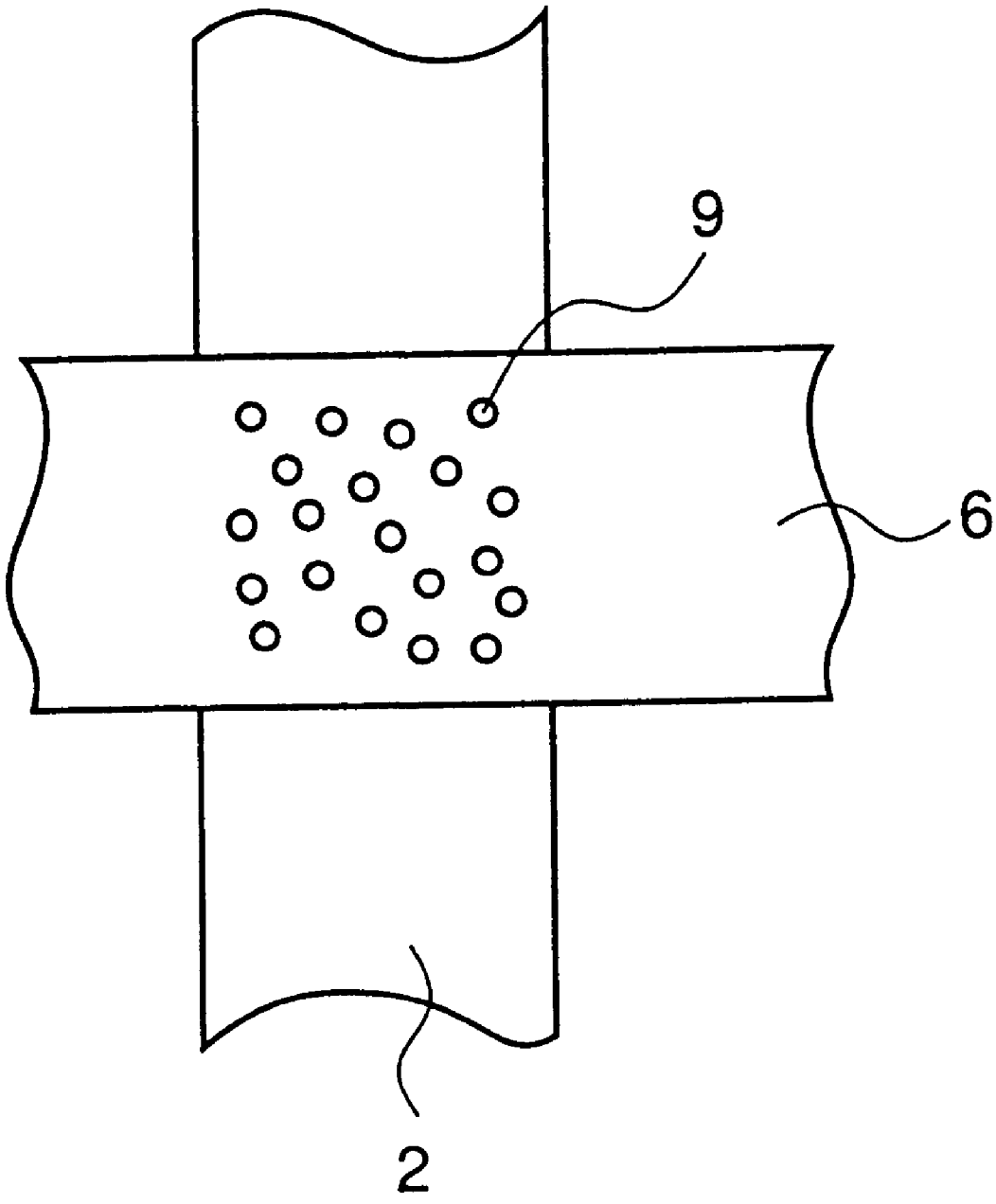
FIG. 5 is a diagram showing the crossing portion between an emitter layer and a gate line layer of the present invention.

Subsequently, the whole substrate is heated up to about 130° C., and subjected to an annealing treatment under a nitrogen gas atmosphere for four hours. After the annealing treatment, the substrate is cooled to the room temperature. At this time, "island" structures 9 of about 1 μm in diameter which mainly contain the alkali-soluble polymer B are uniformly dispersed at a pitch of 2 to 3 μm in the "sea" which mainly contains the polymer insoluble in the developing liquid as shown in FIG. 5. Reflowing of the polymer film occurs in the annealing treatment, so that the film thickness is finally equal to about 1 μm just above the gate wires 6. This polymer film is not coated on the lead-out areas of the emitter lines.

Here, the whole substrate is immersed in the developing liquid for 10 minutes, and rinsed with pure water. As a result, the "island" portions 9 are perfectly removed and the gate wires 6 are exposed to the outside.

Subsequently, the gate lines 6 are etched and further the insulating layer 5 below the gate lines 6 is etched by using RIE. At this time, the insulating layer 5 covering the lead-out portions of the emitter lines at the edge portions of the substrate 1 is also removed at the same time, and the emitter lines are exposed, whereby the openings 9 are formed at the crossing portions between the emitter lines 2 and the gate lines 6.

Through the above process, the wiring line matrix comprising the emitter lines 2 and the gate lines 6 is formed on the substrate 1.

(Step 6)

Subsequently, as shown in FIG. 2, the resistance layer 3 and the fine particle emitter layer 4 are deposited and formed preferably by electrophoresis. This work is preferably carried out by grouping the emitter wires to some groups. For example, respective 100 emitter wires are grouped, and the above work is carried out every 100 lines.

A mixture of polyimide fine particles of about 100 nm in particle diameter (produced by PI Technology Research) and a fullerene-containing carbon fine particles of 10 nm in particle diameter at a weight ratio of 1000:1 may be used as the constituent element of the resistance layer 3. This mixture is dispersed in the dispersing solvent 22. The dispersing solvent used in this embodiment is "Isopar-L" obtained from Exxon Chemicals. The weight ratio of the dispersing solvent and the mixture of polyimide and carbon fine particles may be set to about 0.4 wt %. Zirconium naphthenate (produced by Dai-nippon Ink & Chemicals, Inc.) is mixed as metallic salt at a weight ratio of about 10% into the mixture of polyimide and carbon fine particles.

The spacing 23 between the counter electrode 21 and the substrate 1 is set to about 100 μm, and the dispersing liquid is filled between the substrate 1 and the counter electrode 21. A voltage is applied across the counter electrode 21 and the emitter lines 2 by using the voltage applying means 24 so that the counter electrode 21 is set to +100V and the emitter lines 2 are set to 0V. At this time, it is preferable to apply ultrasonic waves to the dispersing liquid.

Just after the voltage is applied, a current of several mA starts to flow, and the current amount decreases exponentially. In the prototype, the current is unobservable in about two minutes. At this point, substantially all of the resistance material dispersed in the dispersing solvent has already been deposited and formed on the substrate 1.

Subsequently, the fine particles adhering onto the gate lines are moved into the solvent by setting the gate lines 6 to +50V and setting the counter electrode 21 to 0V.

The above embodiment uses the two-step voltage application method of applying the voltage across the counter electrode 21 and the emitter lines 2 at a first step and then applying the voltage across the gate electrodes 6 and the counter electrode 21 at a second step. However, the same effect can be achieved by applying the voltages to the counter electrode 21, the gate electrodes 6 and the emitter wires 2 at the same time so that the following condition is satisfied:

(the voltage of the counter electrode 21)>(the voltage of the gate electrodes 6)>(the voltage of the emitter lines 2)

Further, in the above embodiment, the fine particles are positively charged by zirconium naphthenate. However, if the fine particles are required to be negatively charged, the positive/negative signs of the applied voltages in the above process may be inverted to achieve the same effect.

Finally, the anneal treatment is conducted under a nitrogen atmosphere at a temperature of about 300° C., whereby the resistance film 3 and the emitter wires 2 can be firmly joined together.

(Step 7)

Subsequently, the fine particle emitter layer is likewise deposited and formed in the same manner.

As the fine particle emitter material are used fine particles of boron nitride of cubic system (c-BN) having a particle size of about 100 nm (SBN-B produced by Showa Denko K.K.) in this embodiment. These fine particles are subjected to a dilute hydrofluoric acid treatment and then subjected to a hydrogen plasma treatment at about 450° C. in advance.

These fine particles thus treated are dispersed in the same solvent as used in the process of forming the resistance layer 3. However, the weight ratio is set to about 0.2%. Further, zirconium naphthenate of about 10 weight % with respect to the fine particles of boron nitride of cubic system is used.

As in the case of the formation step of the resistance layer 3, the film formation on the resistance layer 3 and the removal of the portion adhering to the gate layer 6 are carried out. Thereafter, the anneal treatment is conducted at about 350° C. under a hydrogen atmosphere to achieve excellent coupling between the fine particle emitter layer 4 and the resistance layer 3.

The electron emission element array substrate is achieved through the above process.

(Step 8)

An ITO anode electrode layer 32 is formed on one side above a face plate 31, and a phosphor 33 is formed at the portion corresponding to pixels.

As shown in FIG. 4, an exhaust pipe 34 and a spacer 35 are attached, and the assembled panel is mounted in a vacuum chamber for measurement. The height of the spacer 35 is set to about 4 mm. The voltage of the anode may be set to about 3500V. The height of the spacer may range between about 100 μm and about 1 mm, and the corresponding voltage range is from about 100 to 2000V, for fluorescence with low energy electrons. The height of the spacer ranges may range from 1 to 10 mm, and the corresponding voltage range is between about 1000 to 30000 V, for fluorescence with high energy electrons.

The measurement of the prototype is carried out with using neither the getter 36 nor the focusing electrode under the condition that the pressure is reduced to $10^{-6}$ torr in the vacuum chamber by a turbo molecular pump.

0V is applied to each emitter wire 2 when the emitter wire 2 is not selected, and about −15V is applied to each emitter wire 2 when the emitter wire 2 is selected. Further, 0V is biased to each gate wire 6 when it is not selected and about +15V is biased to each gate wire 6 when it is selected. As a result, electron emission occurs and a luminescent point is confirmed on the phosphor.

A plurality of pixels is selected over the overall display area of the display, and the brightness on the display area is measured under the same condition, so that the dispersion is within 3%.

Next, the second embodiment of the electron emission element of the present invention will be described. The structure of the electron emission element used in this embodiment is the same as the first embodiment described above. In the following description, another method of manufacturing the array of the electron emission elements in the present invention will be described.

(Steps 1 to 6)

These steps are the same as the method of the first embodiment, and thus the description thereof is omitted.

Through the above steps, the emitter lines 2, the insulating layer 5, the resistance layer 3 and the fine particle emitter layer 4 are formed on the substrate 1.

(Step 7)

Subsequently, the fine particle emitter 4 is deposited and formed, SiC fine particles produced by Sumitomo Osaka Cement Co., Ltd. are, used as the fine particle emitter material. The fine particles are subjected to the heat treatment for about 20 minutes at 1700° C. under a vacuum state of about $10^{-4}$ torr in advance, whereby the surfaces thereof are denatured. The average particle diameter before the treatment is equal to about 30 nm.

These fine particles are dispersed in the same solvent as used in the first embodiment (i.e., Isopar-L). The weight ratio thereof is set to about 0.2%. It is preferable to add zirconium naphthenate of about 10 weight % with respect to the weight of SiC particles.

Subsequently, through the procedure of the step 8 of the first embodiment, a film of the SiC fine particles is deposited on the resistance layer and the SiC fine particles adhering to the gate layer 6 are removed. Thereafter, the anneal treatment is conducted at about 400° C. under a nitrogen atmosphere to achieve excellent coupling between the fine particle emitter layer 4 and the resistance layer 3.

(Step 8)

The ITO anode electrode layer 32 is formed on the face plate 31, and the phosphor 33 is coated on the portion corresponding to the pixels. The result thus obtained and the electron emission array produced through the steps 1 to 7 are combined with each other, and the exhaust pipe 34, the spacer 35, the getter 36 and the focusing electrode 37 are secured as shown in FIG. 3.

Thereafter, the exhaust is carried out by performing rough evacuation with a rotary pump and then pressure-reduction to $10^{-8}$ torr with a turbo molecular pump 10.

Finally, a getter pump is installed, and the overall panel thus fabricated is evacuated at about 200° C., and then the exhaust pipe is cut and sealed while it is pumped by the getter pump, thereby keeping the overall panel sealed. Thereafter, the temperature is reduced to the room temperature.

In the prototype, the voltage of the anode is set to about 5000V. 0V is applied to the emitter lines 2 and the gate lines 6 when they are not selected, and −5V and +5V are biased to the emitter lines 2 and the gate lines 6 respectively when they are selected, whereby the electron emission occurs and the luminescent point is confirmed on the phosphor. Further, a plurality of pixels are selected on the overall display area of the display, and the brightness is measured under the same condition, so that the dispersion is within 2%.

Next, a third embodiment of the display device according to the present invention will be described in detail.

Figure 6:
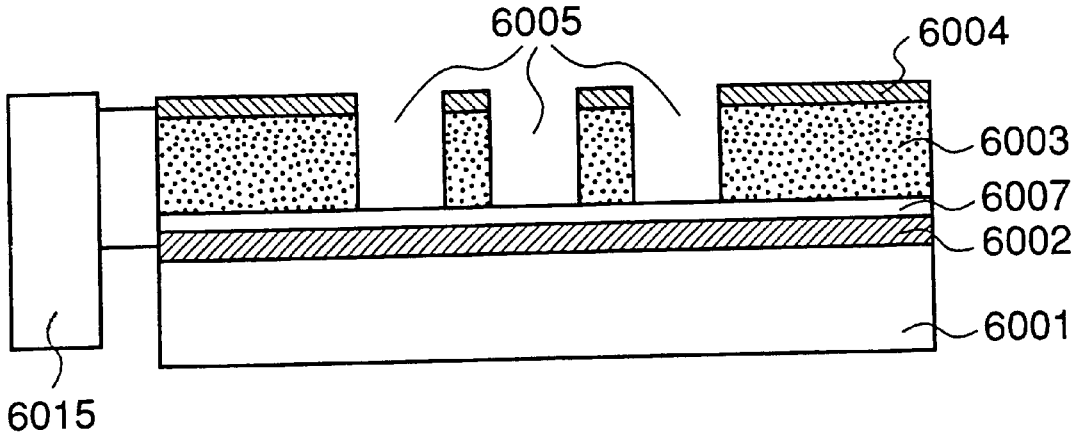
FIG. 6 is a cross-sectional view schematically showing a part of a display device of the present invention.
Figure 7:
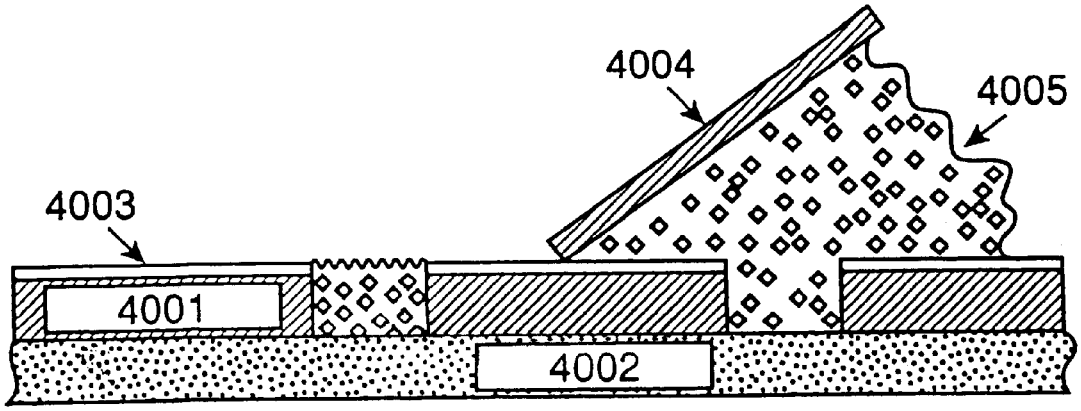
FIG. 7 BACKGROUND ART
FIG. 7 is a partially cross-sectional view showing a conventional electron emission element and a method of forming the electron emission element.
Figure 8:
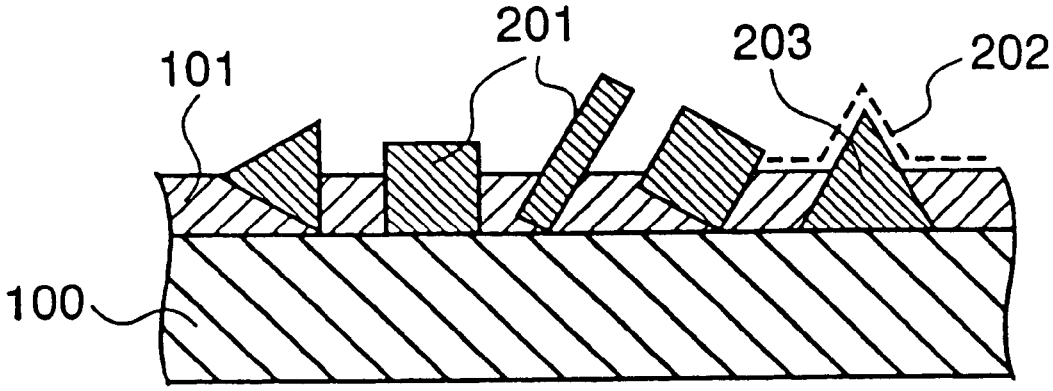
FIG. 8 BACKGROUND ART
FIG. 8 is a cross-sectional view showing another conventional electron emission element.
Figure 9:
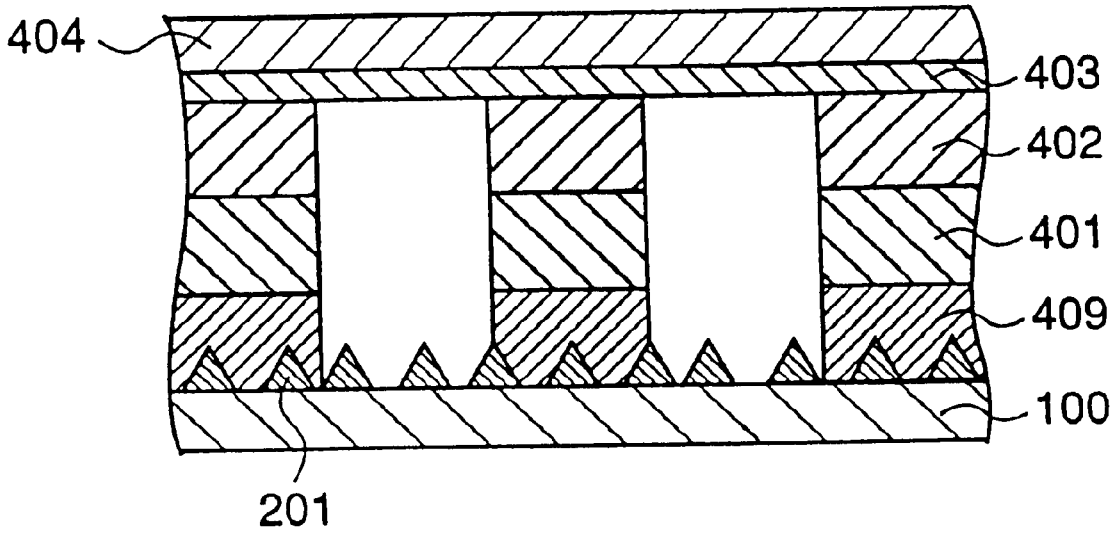
FIG. 9 BACKGROUND ART
FIG. 9 is a cross-sectional view showing another conventional electron emission element.
Figure 10:
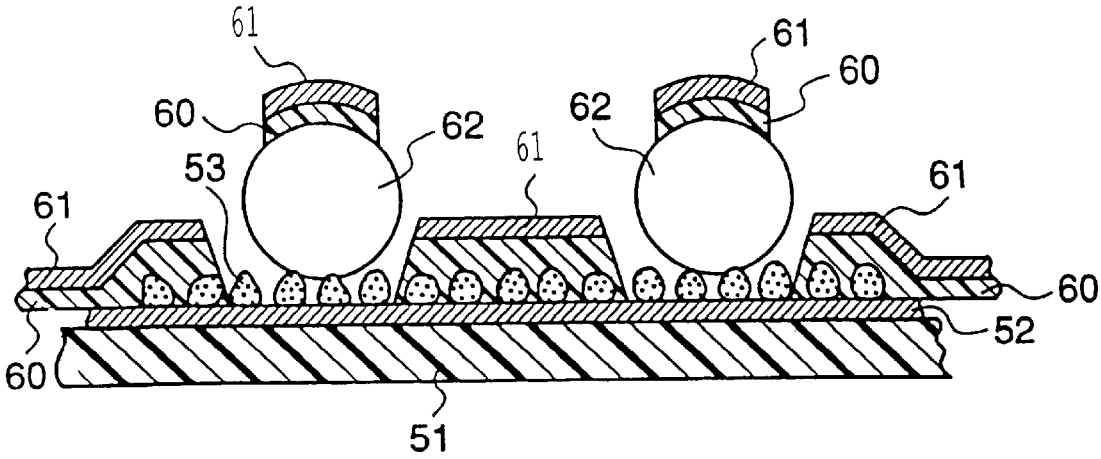
FIG. 10 BACKGROUND ART
FIG. 10 is a partially cross-sectional view showing another conventional electron emission element.
Figure 11:
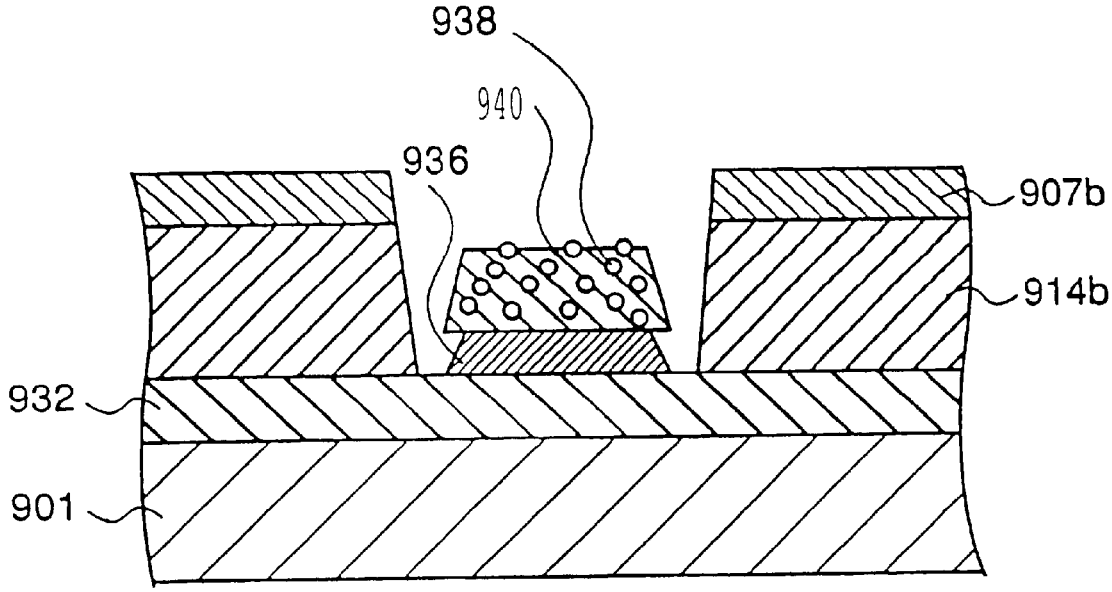
FIG. 11 BACKGROUND ART
FIG. 11 is a cross-sectional view showing another conventional electron emission element.

FIG. 6 is a cross-sectional view schematically showing a part of this embodiment.

A plurality of stripe-shaped cathode electrode lines 6002 are formed on the surface of a lower substrate 6001 formed of glass. A thin film 6007 for a cold cathode is formed on these cathode electrode lines 6002. Further, a plurality of gate electrode lines 6004 are formed on the thin film 6007. The gate electrode lines 6004 are formed in a stripe shape so as to cross the cathode electrode lines 6002. Accordingly, the cathode electrode lines 6002 and the gate electrode lines 6004 are designed in a matrix structure. Each cathode electrode line 6002 and each gate electrode line 6004 are connected to control means 6015 to control the driving operation thereof.

A number of substantially circular holes 6005 are formed in the cross area between each cathode electrode line 6002 and each gate electrode line 6004 so as to pierce through the cathode electrode line 6002 and the insulating layer 6003 and reach the thin film 6007 for the cold cathode. The thin film 6007 exposed to the bottom portions of the holes 6005 constitutes the cold cathode. The thin film 6007 comprises an assembly of fine particles which are coated with interfacial active agent and formed of material having a small work function. The insulating layer 6003 is formed of silicon oxide containing fluorine.

Figure 12:
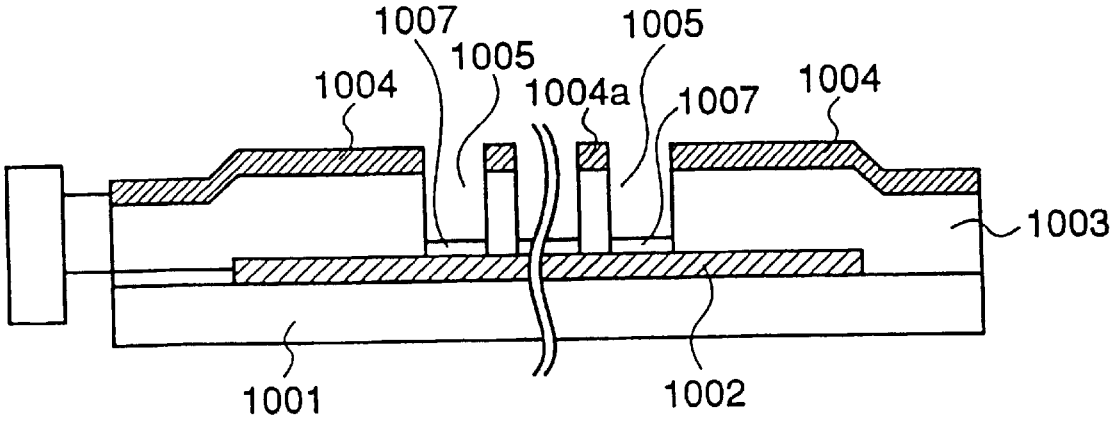
FIG. 12 BACKGROUND ART
FIG. 12 is a cross-sectional view showing a conventional display device.
Figure 13:
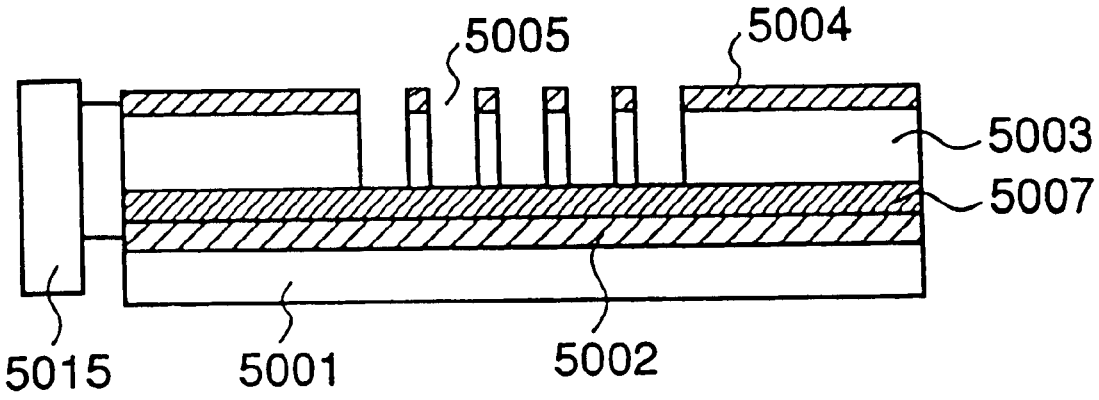
FIG. 13 BACKGROUND ART
FIG. 13 is a perspective view showing a conventional emission source.
Figure 14:
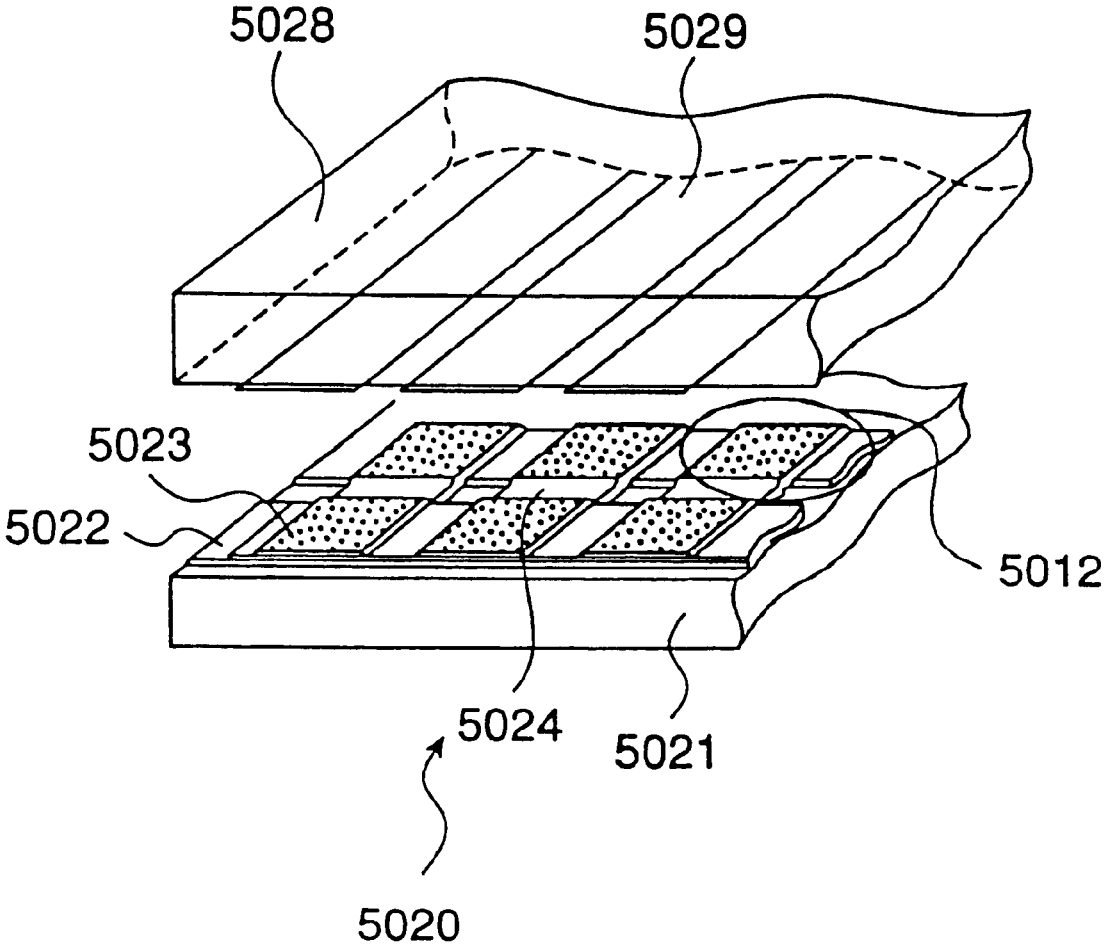
FIG. 14 BACKGROUND ART
FIG. 14 is a perspective view showing a conventional display device.

The construction and display operation of the display device using the electron emission source of this embodiment is the same as the conventional display device shown in FIG. 12.

Next, the manufacturing process of the cold cathode of this embodiment will be described.

Ag paste is coated in a stripe shape on a glass plate 6001 of about 3 mm in thickness by the screen printing method and then baked to form cathode electrode lines 6002.

Further, there is prepared dilute detergent, aminopropyl triethoxysilane, into which c-BN fine particles of about 10 nm in particle diameter are mixed and stirred.

The detergent thus prepared is coated on the glass plate 6001, and then cured to volatilize the organic solvent. Further, the glass plated coated with the detergent is subjected to a heat treatment for about 2 hours at about 350° C. under the atmospheric air to fix Ag of the cathode electrode lines and c-BN to each other. The patterning process is carried out on the cold cathode thin film 6007 thus forming every pixel by a normal PEP. (Photolithography) step. Although c-BN has various resistivity values depending on the degree of doping by sulfur, c-BN having resistivity in the range of from 102 to 1010 ωm is generally used in its application.

Subsequently, $SiO_2$ fine particles are dissolved in hydrosilicofluoric acid solution of about 3 mol/l in concentration and saturated, and then a piece of 99.9% purity aluminum is added to the saturated solution thus obtained. Thereafter, the glass plate 6001 is immersed in the above solution for about 30 hours while keeping the temperature of the liquid to about 60° C., whereby the $SiO_2$ film containing fluorine is deposited with a thickness of 10 $\mu$m. The $SiO_2$ film containing fluorine thus formed serves as the insulating layer 6003. Since the detergent aminopropyl triethoxysilane is coated on the surfaces of the c-BN fine particles, the adhesion between the emitter layer 6007 and the insulating layer 6003 is sufficient.

Next, the stripe-shaped gate electrode lines 6004 are printed on the insulating layer and baked. At this time, the gate electrode lines 6004 are formed so that the cathode electrode lines 6002 and the gate electrode lines 6004 are arranged so as to cross each other on the emitter layer 6007 which is patterned every pixel. Thereafter, a resist mask is formed on the gate electrode lines 6004 and the insulating layer 6003 by the normal PEP step.

Thereafter, as in the case of the first embodiment, substantially circular holes having about a radius of 1 micrometer, which is equivalent to about 3000 holes per pixel, are formed. The etching of the insulating layer 6003 is performed with dilute hydrofluoric acid, and the emitter layer 6007 is exposed at the bottom portions of the holes 6005 thus formed. Coinciding the patterning of the insulating layer 6003, the hydrogen terminating treatment is conducted on the surfaces of the c-BN fine particles of the emitter layer 6007. At this time, the emitter fine particles have been broadly formed on the cathode wires 6002, so that the positioning work in the formation process of the holes is easily performed and thus the reliability is not lost by the positioning work.

The concentration of fluorine contained in the $SiO_2$ insulating layer 6003 thus obtained is equal to about 2.8%, and the dielectric constant at 1 MHz is equal to about 3.5. Since the dielectric constant of the $SiO_2$ film formed by the chemical vapor deposition method, the high-frequency sputtering method or the like is generally equal to about 4.3, the dielectric constant can be reduced to a remarkably small value in this embodiment as compared with the normal dielectric constant value. The area of one pixel is equal to about $1.6\times10^{-7}$, and the electrostatic capacitance per pixel is equal to 0.495 pF in the prototype.

Next, a fourth embodiment of the present invention will be described. The display device is formed in the same manner as the third embodiment.

A paste containing $SiO_2$ fine particles of about 100 nm in diameter are coated on a glass plate having cathode electrode lines and emitters formed thereon, and then dried.

Further, $SiO_2$ fine particles are dissolved in hydrosilicofluoric acid solution of about 3 molars in concentration and saturated. Then, a piece of 99.9% purity aluminum is added to the solution thus saturated.

The substrate plate is immersed in the solution thus obtained for about 30 hours while keeping the temperature of the solution at about 60° C., and the $SiO_2$ film containing fluorine is deposited at a thickness of about 10 $\mu$m. Thereafter, the anneal treatment is conducted for about one hour at about 400° C. under atmospheric pressure air to form the insulating layer.

A fifth embodiment according to the present invention will be described.

The display device is formed in the same manner as the third embodiment except that polyimide containing boron is deposited by an electrodeposition method to form the insulating layer. That is, after the emitter layer is formed, polyimide containing fluorine is electrodeposited on the emitter layer to form the insulating layer. The concentration of fluorine contained in the $SiO_2$ insulating film for the cold cathode thus obtained is equal to about 2.5%, and the dielectric constant at 1 MHz is equal to about 3.0.

The following effects can be achieved by the electron emission element and the method of manufacturing the electron emission electrode in the present invention.

(1) By fabricating the resistance layer having a sufficient current limiting effect into the electron emission element, the maximum current amount flowing into each electron emission element can be effectively restricted. By the present invention, the resistance layer as described above can be applied to fine particle emitters. Therefore, even when the present invention is applied to a display, there can be prevented occurrence of unevenness of brightness in which extremely bright luminescent points are dispersed.

(2) The resistance layer and the fine particle emitter layer can be selectively formed on the emitter lines in the opening portions of the gates. Accordingly, the short-circuiting between the emitter lines and the gate lines can be prevented. Further, the resistance layer and the fine particle emitter layer can be formed while keeping uniformity, which would be unachievable by the other methods such as coating, etc.

According to the display device of the present invention, since the $SiO_2$ insulating layer contains fluorine, the insulating layer having a dielectric constant of about 3.5 can be formed on the array substrate. That is, the insulation layer can be provided with a dielectric constant which is much lower than the dielectric constant of about 4.3 of the $SiO_2$ film formed by the normal thin film forming method which is represented by the chemical vapor deposition method or the high-frequency sputtering method, whereby the parasitic capacitance per pixel can be reduced and thus the thickness of the insulating layer can be also reduced. Accordingly, the distance between the gate and the emitter can be shortened, and the driving voltage can be reduced.

In addition, the insulating layer formed by using the liquid phase deposition method enables formation of an $SiO_2$ film which is more minute as compared with the $SiO_2$ film formed by the thin film forming method which is represented by the chemical vapor deposition method or the high-frequency sputtering method. That is, a film having a superior insulating property can be achieved. Accordingly, the leak current can be reduced and the breakdown voltage can be increased, so that the power consumption efficiency and the reliability can be enhanced. Further, the thickness of the insulating film can be reduced and thus the gate-emitter distance can be shortened, so that the driving voltage can be reduced.

As compared with the thin film forming method represented by the chemical vapor deposition method or the high-frequency sputtering method, the liquid phase deposition is superior in uniformity of film thickness and film quality. Accordingly, even when a large-scale display device of 40 inches or more is manufactured, a device having little unevenness in image quality can be provided.

Further, the film formation can be performed at a low temperature, so that thermal damage such as oxidation or the like which would be applied to the cathode electrode lines and the emitters can be remarkably reduced. Therefore, the present invention contributes to the enhancement of yield and reliability.

Still further, in the process of forming the $SiO_2$ film by the liquid phase deposition method, there is provided such selective growth that no $SiO_2$ film is formed on the portion which is provided with a resist mask in advance. Accordingly, $SiO_2$ is grown on an area other than the resist-mask provided area, whereby the insulation layer can be subjected to the patterning treatment without etching $SiO_2$.

The material which suffers damage by the etching liquid for $SiO_2$, for example, dilute hydrofluoric acid or ammonium fluoride may be used for the emitters.

Further, since a special apparatus such as a chemical vapor deposition apparatus or high-frequency sputtering apparatus is not needed, the batch treatment can be performed regardless of the size of the substrate. Accordingly, the presents invention contributes to reduction in cost and enhancement in productivity.

Obviously, numerous modifications and variations of the present invention are possible in light of the above teachings. For example, film thicknesses, film pattern sizes, particle materials, chemicals, etc. were given in the above embodiments. These values are not intended to limit the invention but are provided as examples to practice the invention. It is therefore to be understood that within the scope of the appended claims, the invention may be practiced otherwise than as specifically described herein.

What is claimed is:

1. A field emission element comprising:

a substrate;

a cathode layer formed on said substrate;

an insulating layer formed on said cathode layer;

a gate layer formed on said insulating layer;

a resistance layer formed on said cathode layer completely inside of an opening penetrating through said insulating layer and said gate layer, said resistance layer comprising particles and covering all of the cathode layer in the opening; and an emitter film layer formed of emitter particles on said resistance layer, said emitter film layer having a standard non-conical film shape.

2. A field emission element according to claim 1, wherein said resistance layer comprises resistive particles, said resistive particles being formed from insulators.

3. A field emission element according to claim 2, wherein said resistance layer further comprises conductive particles.

4. A field emission element according to claim 1, wherein said resistance layer comprises conductive particles dispersed in an insulating material.

5. A field emission element according to claim 3, wherein a surface of at least one of said conductive particles, said resistive particles, and said emitter particles comprises a metallic salt.

6. A field emission element according to claim 3, wherein said conductive particles are selected from a group of graphite, amorphous carbon, fullerenes, nano-fiber of carbon and graphite nano-fiber.

7. A field emission element according to claim 2, wherein diameters of said resistive particles are substantially between 5 nanometers and 500 nanometers.

8. A field emission element according to claim 1, wherein said emitter particles are selected from a group of diamond, boron nitride of cubic system, boron nitride of hexagonal system, aluminum nitride, $CeO_2$, $Ho_2O_3$, HfC, ZrC and SiC.

9. A field emission element according to claim 1, wherein said emitter particles are selected from a group of diamond, boron nitride of cubic system, boron nitride of hexagonal system, aluminum nitride subjected to an activation treatment.

10. A field emission element according to claim 1, wherein said insulating layer comprises $SiO_2$ including fluorine.

11. A field emission display according to claim 1, wherein said insulating layer contains not less than 2% fluorine.

12. A field emission display according to claim 1, wherein said emitter particles are coated by detergent.

13. A field emission display according to claim 1, wherein plural of said openings are formed at random in an overlapping area of said cathode layer and said gate layer.

14. A field emission display according to claim 1, wherein diameters of said openings are substantially 1 micrometer.

15. A field emission display according to claim 1, wherein said resistive layer has a structure formed on said cathode in said open by electrophoresis after said cathode, insulating layer and gate layer are formed.

16. A field emission display according to claim 15, wherein said resistance layer has a structure formed by applying a cathode electrical potential to said cathode, and applying a gate electrical potential to said gate after impressing said cathode electrical potential.

17. A field emission display according to claim 15, wherein said resistance layer has a structure formed by simultaneously applying a cathode electrical potential to said cathode and a gate electrical potential to said gate, wherein said gate electrical potential is higher than said cathode electrical potential in the case that particles for electrophoresis are charged positive, and said gate electrical potential is lower than said cathode electrical potential in the case that particles for electrophoresis are charged negative.

18. A field emission display comprising;

a substrate;

a cathode layer formed on said substrate;

an insulating layer formed on said cathode layer;

a gate layer formed on said insulating layer;

a resistance layer formed on said cathode layer completely inside of an opening penetrating through said insulating layer and said gate layer, said resistance layer comprising particles and covering all of the cathode layer in the opening;

an emitter film layer formed of emitter particles on said resistive layer, said emitter film layer having a standard non-conical film shape;

an anode layer opposing said substrate; and a fluorescent layer on said anode layer.

19. A field emission display according to claim 18, wherein said insulating layer is formed by $SiO_2$ containing fluorine.

20. A field emission display according to claim 18, wherein plural of said openings are formed at random in an overlapping area of said cathode layer and said gate layer.

21. A field emission display according to claim 20, wherein diameters of said openings are substantially 1 micrometer.

22. A field emission display according to claim 18, wherein said resistance layer comprises resistive particles.

23. A field emission display according to claim 18, wherein diameters of said resistive particles are substantially between 5 nanometers and 500 nanometers.

24. A field emissive element according to claim 4, wherein said conductive particles are selected from a group of graphite, amorphous carbon, fullerenes, nano-fiber of carbon and graphite nano-fiber.

* * * * *